US005565313A

United States Patent [19]

Ishidai et al.

[11] Patent Number: 5,565,313

[45] Date of Patent: Oct. 15, 1996

[54] SILVER HALIDE COLOR PHOTOGRAPHIC LIGHT-SENSITIVE MATERIAL

[75] Inventors: Hiroshi Ishidai; Hiroshi Kita; Yutaka Kaneko, all of Hino, Japan

[73] Assignee: Konica Corporation, Tokyo, Japan

[21] Appl. No.: 612,072

[22] Filed: Mar. 7, 1996

Related U.S. Application Data

[63] Continuation of Ser. No. 354,642, Dec. 13, 1994, abandoned.

[30] Foreign Application Priority Data

Dec. 20, 1993 [JP] Japan ..... 5-320185

[51] Int. Cl.[6] ..... G03C 7/38

[52] U.S. Cl. ..... 430/551; 430/558

[58] Field of Search ..... 430/558, 551

[56] References Cited

U.S. PATENT DOCUMENTS

| | | | |
|---|---|---|---|
| 2,600,788 | 6/1952 | Loria et al. | 95/6 |
| 2,807,653 | 9/1957 | Filbey et al. | 260/619 |
| 3,519,429 | 7/1970 | Lestina | 96/100 |
| 3,725,067 | 4/1973 | Bailey et al. | 96/56.5 |
| 3,758,309 | 9/1973 | Bailey et al. | 96/136 |
| 3,810,761 | 5/1974 | Bailey et al. | 96/84 R |
| 5,032,497 | 7/1991 | Nakayama et al. | 430/558 |
| 5,063,148 | 11/1991 | Sugita et al. | 430/558 |
| 5,104,782 | 4/1992 | Seto et al. | 430/558 |
| 5,254,451 | 10/1993 | Kita et al. | 430/558 |

FOREIGN PATENT DOCUMENTS

| | | |
|---|---|---|
| 5-241283 | 9/1993 | Japan . |
| 5-241287 | 9/1993 | Japan . |

*Primary Examiner*—Lee C. Wright
*Attorney, Agent, or Firm*—Finnegan, Henderson, Farabow, Garrett & Dunner, L.L.P.

[57] ABSTRACT

Disclosed is a silver halide color photographic light-sensitive material comprising at least one of magenta coupler represented by Formula I or II:

Formula I

Formula II wherein $R^1$ and $R^4$ each represent a substituent; $R^2$ and $R^3$ each represent a substituted or unsubstituted alkyl group; $L_1$ and $L_2$ each represent a substituted or unsubstituted alkylene group, an arylene group, an aralkylene group or an arylenealkylene group; Y represents $R^5$ and $R^6$ each represent a substituent; $X_1$ represents a hydrogen atom or a group capable of splitting off upon reacting with an oxidized product of a color developing agent; Z represents non-metal atomic group forming a 5-membered or 6-membered heterocyclic ring together with a nitrogen atom; m and n each represent an integer of 0 or 1; p represents an integer of 0 to 4; q represents an integer of 0 to 2, provided that when p is 2 or more, $R^4$ may be the same or different; and each of them may form a ring.

8 Claims, No Drawings

SILVER HALIDE COLOR PHOTOGRAPHIC LIGHT-SENSITIVE MATERIAL

This application is a continuation of application Ser. No. 08/354,642 filed Dec. 13, 1994, now abandoned.

FIELD OF THE INVENTION

This invention relates to a silver halide color photographic light sensitive material containing a magenta coupler and, particularly, to a silver halide color photographic light sensitive material in which a color reproducibility and color producibility can be excellent and a dye image stable against heat and light can be obtained when containing a novel pyrazoloazole type magenta coupler therein.

BACKGROUND OF THE INVENTION

As for the couplers generally applicable to silver halide color photographic light sensitive materials, there have been known couplers including, for example, the yellow couplers each comprising a open-chained ketomethylene type compound, the magenta couplers each comprising a pyrazolone or pyrazoloazole type compound and the cyan couplers each comprising a phenol or naphthol type compound. Among them, a 5-pyrazolone compound has very often been used for the magenta couplers so far.

The known pyrazolone magenta couplers are described in, for example, U.S. Pat. Nos. 2,600,788 and 3,519,429 and Japanese Patent Publication Open to Public Inspection (hereinafter referred to as JP OPI Publication) Nos. 49-111631(1974) and 57-35858(1982). However, the dyes made of the pyrazolone magenta couplers have produced an undesirable side-absorption which has been demanded for the improvements, as described in 'The Theory of the Photographic Process', the 4th Ed., Macmillan Publishing Co., 1977, pp.356–358; 'Fine Chemical', Vol.14, No.8, CMC Press, pp.38–41; and the Lecture Transcription published at the 1985 Annual convention of the Society of Photographic Science of Japan, pp.108–110.

As described in the above-given literatures, the dyes made of the pyrazoloazole type magenta couplers do not produce any side-absorption. The above-given literatures, U.S. Pat. Nos. 3,725,067, 3,758,309 and 3,810,761 and so forth describe that the couplers of this type are excellent.

However, the light-fastness of azomethine dyes made of the couplers are so seriously low that the characteristics of color photographic light sensitive materials, particularly those of print type color photographic light sensitive materials are seriously spoiled.

The studies and researches have been tried for improving the light-fastness. For example, JP OPI Publication Nos. 59-125732(1984), 61-282845(1986), 61-292639(1986) and 61-279855(1986) disclose the techniques of making combination use of a pyrazoloazole type coupler and a phenol type compound or a phenylether compound and JP OPI Publication Nos. 61- 72246(1986), 62-208048(1987), 62-157031(1987) and 63- 163351(1988) disclose the techniques of making combination use of a pyrazoloazole type coupler and an amine type compound.

Further, JP OPI Publication No. 63-24256(1988) proposes for a pyrazoloazole type magenta coupler having an alkyloxyphenyloxy group.

In the above-given techniques, the light-fastness of magenta dye images are still unsatisfactory and the improvements thereof have been eagerly demanded.

SUMMARY OF THE INVENTION

This invention has been made for solving the above-mentioned problems. It is, therefore, an object of the invention is to provide a silver halide color photographic light sensitive material excellent in color reproducibility and color developability and remarkably improved in light-fastness of magenta dye images.

The above-mentioned objects can be achieved with a silver halide color photographic light-sensitive material containing at least one kind of a magenta coupler represented by the following Formula [I] or [II]:

Formula [I]

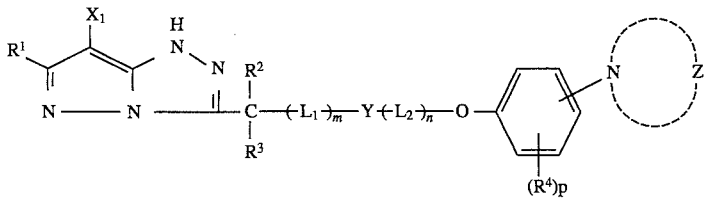

Formula [II]

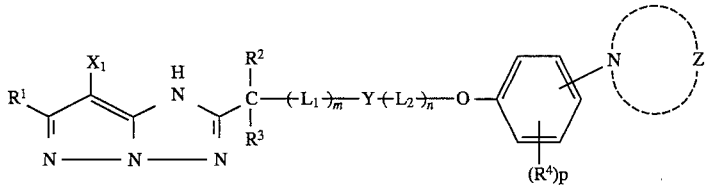

wherein $R^1$ and $R^4$ each represent a substituent; $R^2$ and $R^3$ each represent a substituted or unsubstituted alkyl group,; $L_1$ and $L_2$ each represent a substituted or unsubstituted alkylene group, arylene group, aralkylene group or an arylenealkylene group; Y represents $$-O-\underset{\underset{O}{\|}}{C}-,\ -\underset{\underset{O}{\|}}{C}-O-,\ -\underset{\underset{O}{\|}}{C}-\underset{\underset{R^5}{|}}{N}-\ \text{or}\ -\underset{\underset{R^6}{|}}{N}-S(O)q-,$$

$R^5$ and $R^6$ each represent a substituent; X represents a hydrogen atom or a group capable of splitting off upon reaction with an oxidized product of a color developing agent; Z represents a non-metal atomic group forming a 5-membered or 6-membered heterocyclic ring together with a nitrogen atom; m and n represent an integer of 0 or 1; p represents an integer of 0 to 4; q represents an integer of 0 to 2; when p is 2 or more, $R^4$ may be the same or different; and each of them may bond each other for forming a ring.

DETAILED DESCRIPTION OF THE INVENTION

Hereunder, the present invention will be described in detail.

In the above-mentioned Formula [I] and [II], there is no specific limitation for the substituents represented by $R^1$ and $R^4$. Typically, an alkyl group, an aryl group, an anilino group, an acylamino group, a sulfonamido group, an alkylthio group, an arylthio group, an alkenyl group and a cycloalkyl group are cited. In addition, a halogen atom, a cycloalkenyl group, an alkinyl group, a heterocyclic ring, a sulfonyl group, a sulfinyl group, a phosphonyl group, an acyl group, a carbamoyl group, a sulfamoyl group, a cyano group, an alkoxy group, an aryloxy group, a heterocyclicoxy group, a siloxy group, an acyloxy group, a carbamoyloxy group, an amino group, an alkylamino group, an imido group, an ureido group, a sulfamoylamino group, an alkoxycarbonylamino group, an aryloxycarbonylamino group, an alkoxycarbonyl group, an aryloxycarbonyl group and a heterocyclicthio group and a spiro compound residual group and a hydrogen carbon residual group having a bridge-head atom are cited.

The alkyl group represented by $R^1$ and $R^4$ include preferably, those having 1 to 32 carbons. They may be either straight-chained or branched.

The aryl group represented by $R^1$ and $R^4$ includes preferably, a phenyl group.

The acylamino group represented by $R^1$ and $R^4$ includes for example, an alkylcarbonylamino group and an arylcarbonylamino group.

The sulfonamide group represented by $R^1$ and $R^4$ includes for example, an alkylsulfonylamino group and an arylsulfonylamino group.

An alkyl component and an aryl component in the alkylthio group and the arylthio group represented by $R^1$ and $R^4$, include for example, the above-mentioned alkyl group and aryl group represented by $R^1$ and $R^4$.

The alkenyl group represented by $R^1$ and $R^4$ include for example, those having 2 to 32 carbons. The cycloalkyl group includes preferably, those having 3 to 12 carbons, and more preferably those having 5 to 7 carbons. The alkenyl group may be either straight-chained or branched.

The cycloalkenyl group represented by $R^1$ and $R^4$ includes preferably, those having 2 to 12 carbons, and more preferably those having 5 to 7 carbons.

The sulfonyl group represented by $R^1$ and $R^4$ includes for example, an alkylsulfonyl group and an arylsulfonyl group;

The sulfinyl group includes for example, an alkylsulfinyl group and an arylsulfinyl group.

The phosfonyl group represented by $R^1$ and $R^4$ includes for example, an alkylphosfonyl group, alkoxyphosfonyl group, an aryloxyphosfonyl group and an arylphosfonyl group.

The acyl group includes for example, an alkylcarbonyl group and an arylcarbonyl group.

The carbamoyl group includes for example, an alkylcarbafamoyl group and an arylsulfamoyl group.

The sulfamoyl group includes for example, an alkylsulfamoyl group and an arylsulfamoyl group.

The acyloxy group includes for example, an alkylcarbonyloxy group and an arylcarbonyloxy group.

The carbamoyloxy group includes for example, an alkylcarbamoyloxy group and an arylcarbamoyloxy group.

The ureido group includes for example, an alkylureido group and an arylureido group.

The sulfamoylamino group includes for example, an alkylsulfamoylamino group and an alkylsulfamoylamino group.

The heterocyclic ring includes preferably, those having a 5-membered to 7-membered group, practically including a 2-furyl group, a 2-thienyl group, a 2-pyrimidynyl group and a 2-benzothiazolyl group.

The heterocyclicoxy group includes preferably, those having 5-membered through 7-membered heterocyclic ring, for example, a 3,4,5,6-tetrahydropyranyl-2-oxy group and a 1 -phenyltetrazole-5-oxy group.

The heterocyclicthio group includes preferably, those having 5-membered through 7-membered heterocyclicthio group including, for example, a 2-pyridylthio group, a 2 -benzothiazolylthio group and a 2,4-diphenoxy-1,3,5-triazole-6-thio group.

The siloxy group includes for example, a trimethylsiloxy group, a triethylsiloxy group and a dimethylbutylsiloxy group.

The imido group includes for example, a succinic acid imido group, a 3-heptadecylsuccinic acid imido group, a phthalic imido group and a glutaric imido group.

The spiro compound residual group includes for example, a spiro[3,3]heptane-1-yl; and The bridge-having hydrogen carbon residual group having a bridge-head atom includes for example, a bicyclo [2.2.1]heptane-1-yl group, a tricyclo[3.3.1.1$^{37}$]decane-1 -yl, 7,7-dimethyl-bicyclo[2.2.1]heptane-1-yl.

Each group represented by $R_1$ and $R_{14}$, in addition, includes those having a substituent.

In the above-mentioned Formulas [I] and [II], as a group capable of splitting off upon reaction with an oxidized product of a color developing agent represented by X include, for example, a halogen atom (chlorine, bromine and fluorine), an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy group, an alkylthio group, an arylthio group, a heterocyclicthio group, an alkyloxythiocarbonylthio group, an acylamino group, a sulfonamido group, a nitrogen-containing heterocyclic ring bonded with a nitrogen atom, an alkyloxycarbonylamino group, an aryloxycarbonylamino group and a carboxyl group. Among them, a chlorine atom is particularly preferable.

In addition, an oligomeric coupler such as a dimeric coupler containing a pyrazolotriazole ring in X and a polymer coupler are included in the present invention.

$R^2$ and $R^3$ in the above-mentioned Formula [I] and [II] each represent an alkyl group having 1 to 32 carbons, and said alkyl group may be straight-chained or branched, and include for example, a methyl group and an ethyl group, isopropyl group and a hexyl group.

The alkylene group represented by $L_1$ and $L_2$ in the above-mentioned Formulas [I] and [II] includes, for example, a methylene group, an ethylene group, a methylmethylene group and a decamethylene group. The arylene group represented by $L_1$ and $L_2$ includes, for example, a phenylene group and a naphthylene group. The aralkylene group and the arylalkylene group represented by $L_1$ and $L_2$ include the following compounds;

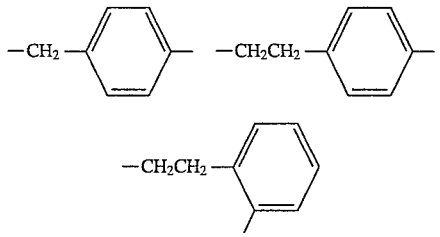

m and n represents an integer of 0 or 1.

In the above-mentioned Formulas [I] and [II], $R^5$ and $R^6$ in each group of

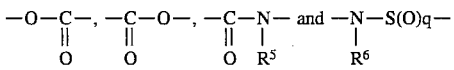

represented by Y include the same as those cited in the above-mentioned $R^1$ and $R^4$. q represents an integer of 0 to 2.

In the above-mentioned Formulas [I] and [II], a 5-membered to 6-membered heterocyclic ring represented by

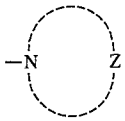

may be saturated or unsaturated. These heterocyclic rings may have a substituent represented by the above-mentioned $R^1$, $R^4$, $R^5$ and $R^6$.

The heterocyclic ring represented by

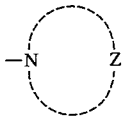

preferably represents

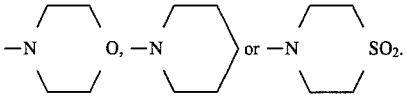

Hereunder, the typical examples of the magenta couplers relating to the present invention will be given. However, the present invention shall not be limited thereto.

(1)

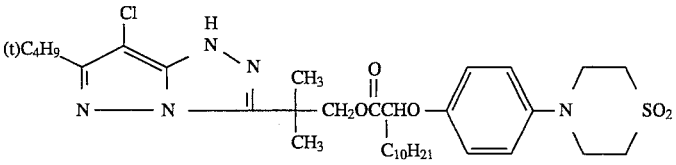

(2)

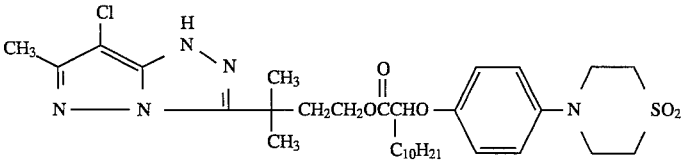

(3)

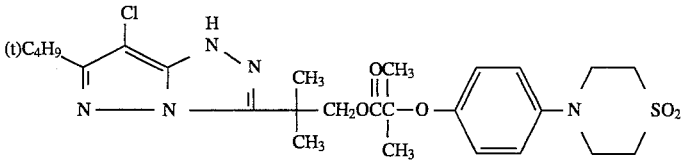

(4)

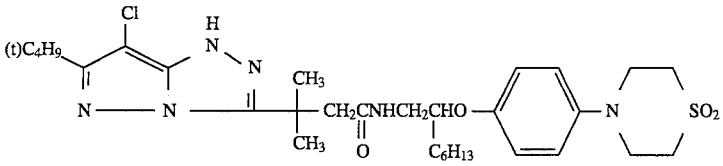

(5)

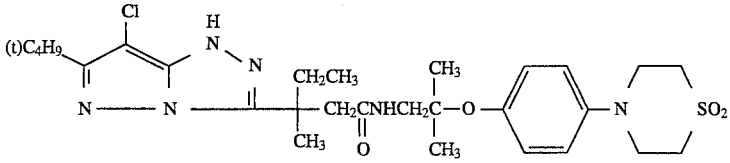

-continued
(6)
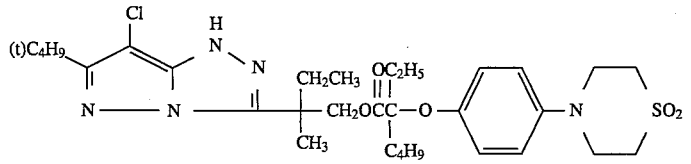
(7)
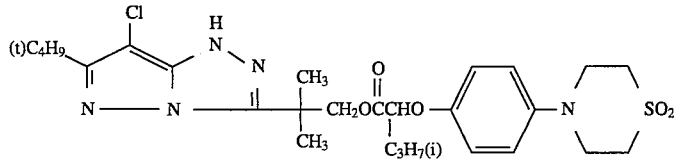
(8)
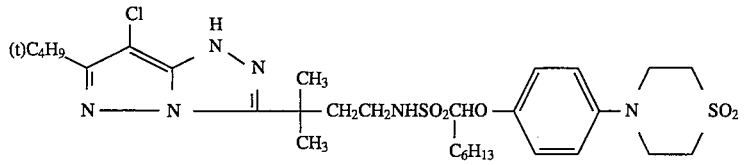
(9)
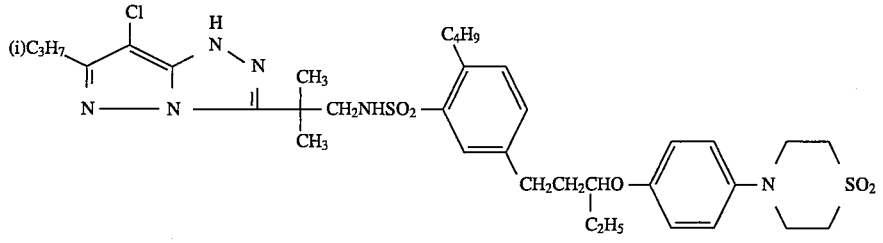
(10)
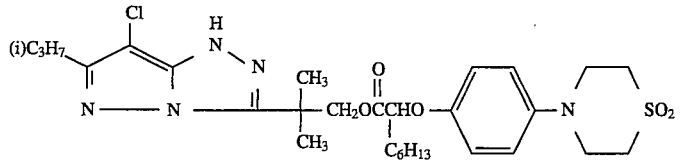
(11)
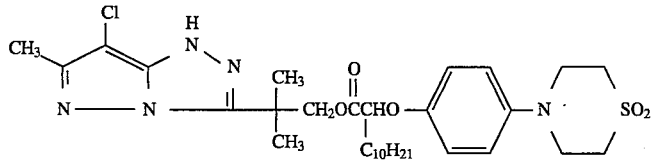
(12)
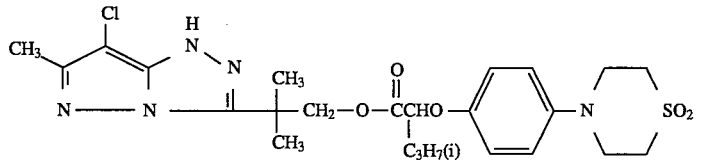
(13)
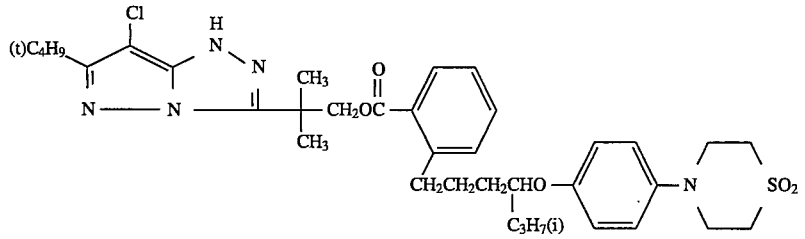
(14)
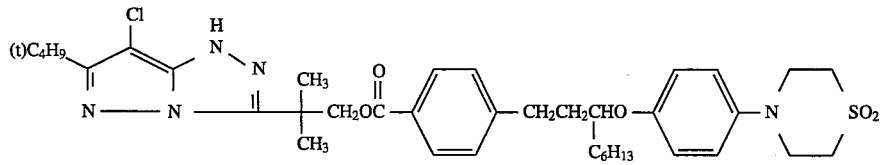

-continued
(15)
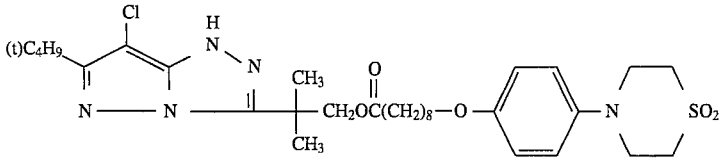
(16)
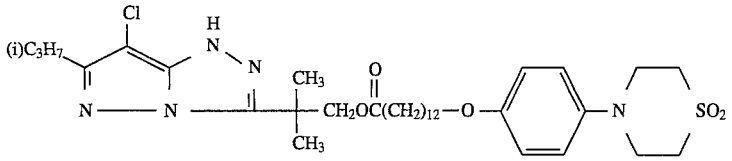
(17)
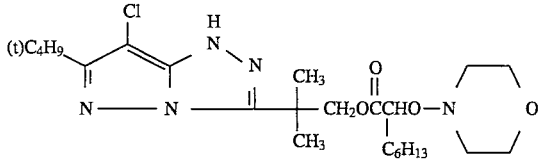
(18)
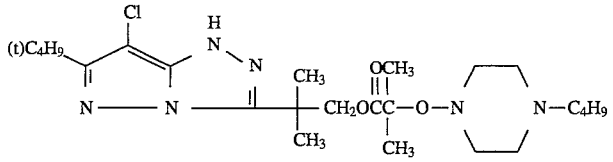
(19)
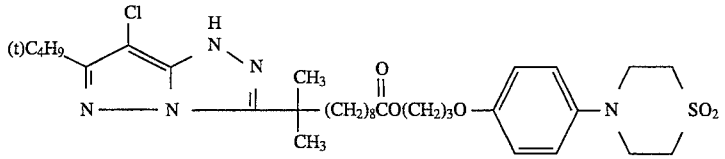
(20)
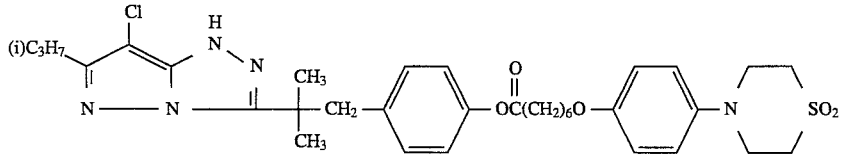
(21)
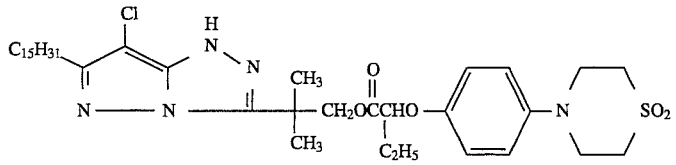
(22)
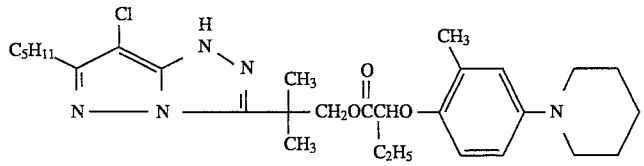
(23)
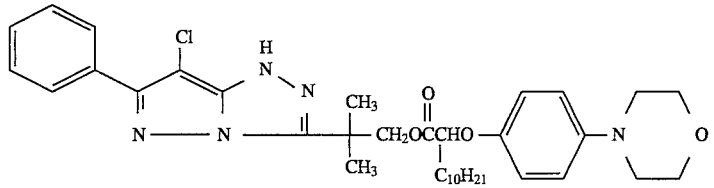

-continued
(24)
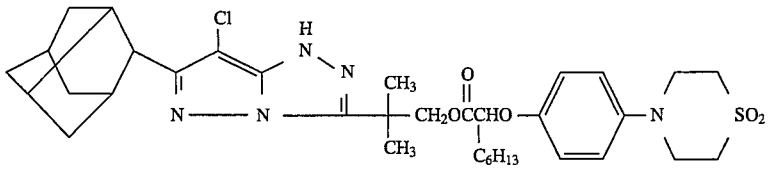
(25)
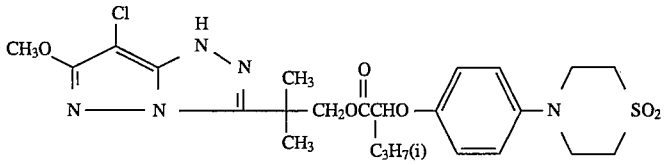
(26)
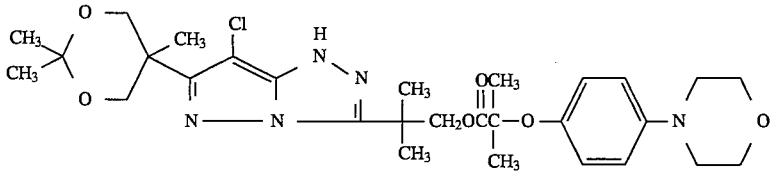
(27)
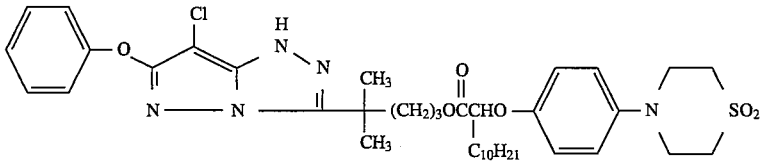
(28)
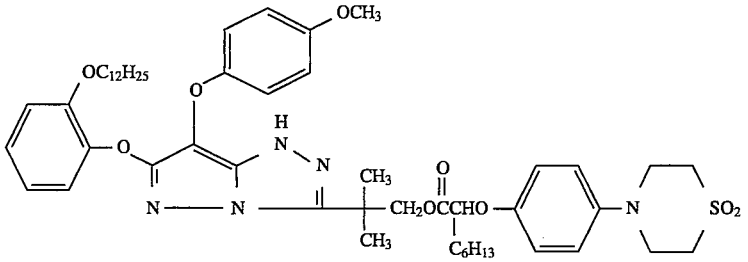
(29)
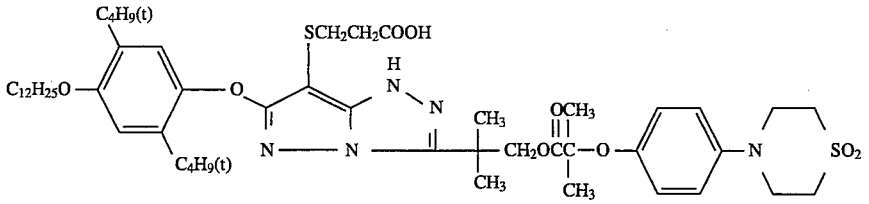
(30)
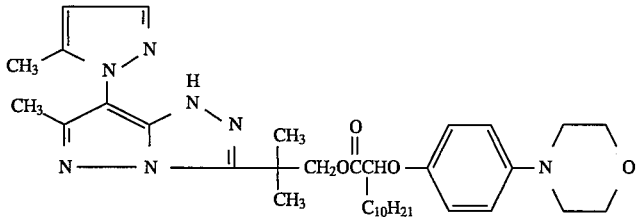
(31)
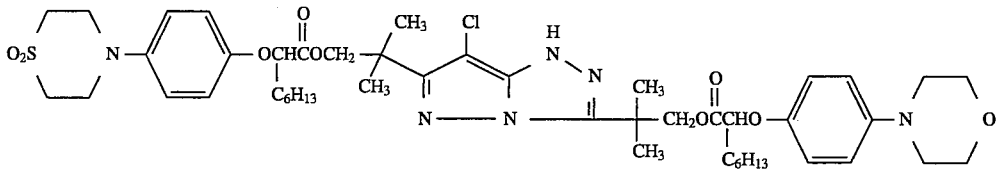

-continued

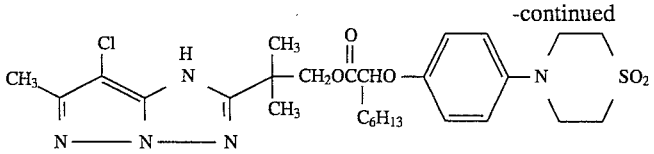

(32)

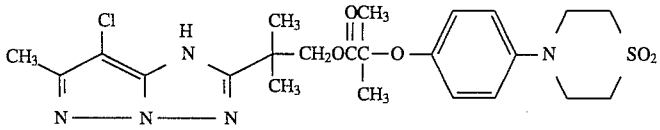

(33)

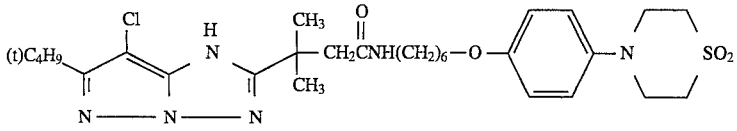

(34)

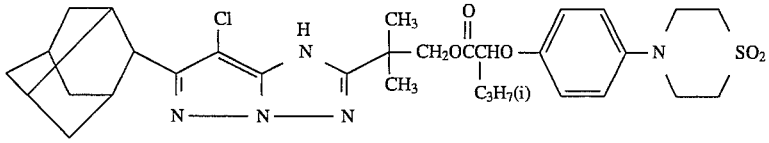

(35)

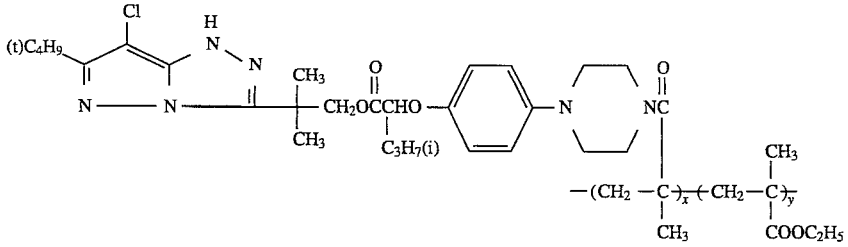

(36)

x:y = 50:50
(in term of mol ratio)

The above-mentioned pyrazoloazole type magenta couplers relating to the invention can readily be synthesized by the skilled in the art with reference to 'Journal of the Chemical Society', Perkin I, 1977, pp.2047–2052; U.S. Pat. No. 3,725,067; JP OPI Publication Nos. 59-99437(1984), 58- 42045(1983), 59-162548(1984), 59-171956(1984), 60-33552(1985), 60-43659(1985), 60-172982(1985), 60-190779(1985), 61- 189539(1986), 61-241754(1986), 63-163351(1988) and 62- 157031(1987).

The typical synthesizing examples of the above-mentioned pyrazoloazole type magenta couplers relating to the invention will now be given below.

Synthesis Examples

<Synthesis of Exemplified Compound (1)>

Synthesis Procedures

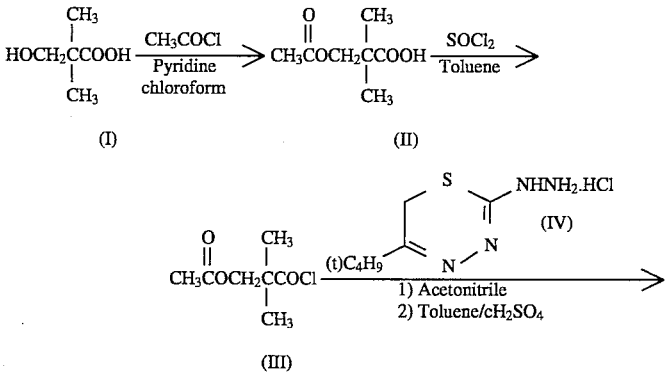

-continued

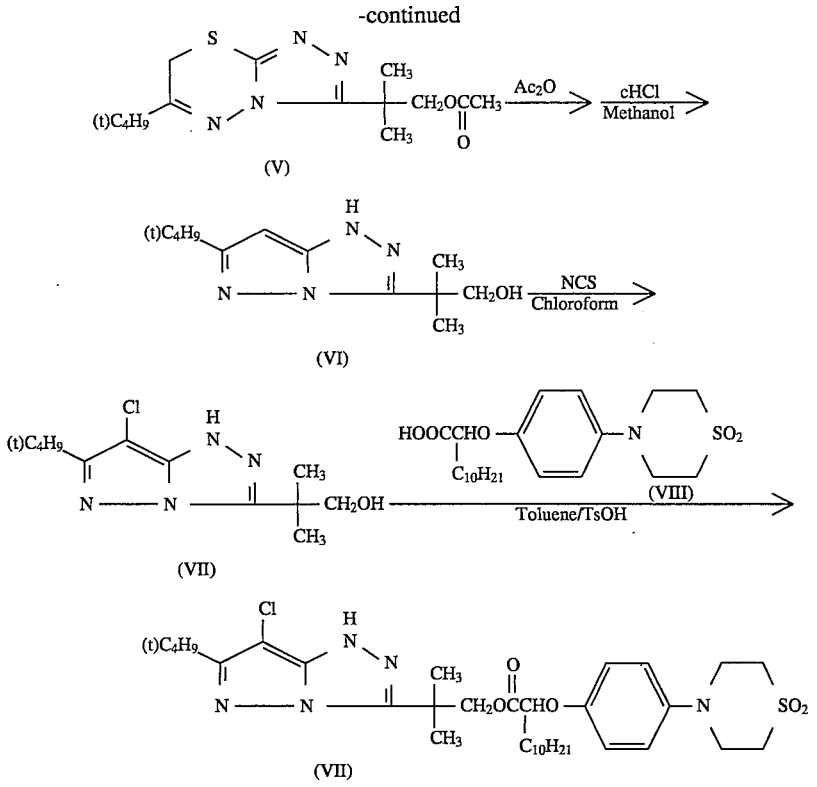

Exemplified compound (1)

<Synthesis of Intermediate (II)>

In 200 ml of chloroform, 118.13 g (1.0 mol) of hydroxypivalic acid (I) was dissolved. To the mixture, 97 ml (1.2 mol) of pyridine was added. In an iced water bath, the mixture was stirred at 5° C. To the resulting solution, 86.35 g (1.1 mol) of acetyl chloride was dropped for 1 hour. After dropping, the solution was stirred for 30 minutes at 5° C. After removing the iced water bath, the solution was stirred for 2 hours at room temperature. The resulting solution was poured into 200 ml of diluted hydrochloric acid subjected to cooling with ice so that the chloroform layer was separated. Then, the solution was washed twice with 200 ml of diluted hydrochloric acid and washed twice with water. After the solution was dried with magnesium sulfate, the chloroform was distilled off under reduced pressure so that white solid was obtained. This white solid was recrystalized with hexane. Thus, 127.3 g (0.795 mol) of white crystalized intermediate (II) was obtained with yield of 79.5%.

<Synthesis of Intermediate (III)>

In 350 ml of toluene, 66.6 g (0.416 mol) of intermediate (II) was dissolved. To the solution, 90 ml (1.21 mol) of thionyl chloride was added. The mixture was heated and refluxed for 4 hours. Toluene which served as a solvent and excessive thionyl chloride were distilled off under reduced pressure. Thus, 74.0 g (0.414 mol) of fine brownish solid intermediate (III) was obtained at yield of 99.6%.

<Synthesis of Intermediate (V)>

In 500 ml of acetonitrile, 76.8 g (0.345 mol) of intermediate (IV) was dissolved. To the solution, 74.0 g (0.414 mol) of intermediate (III) was added. The mixture was heated and refluxed for 2 hours. After heating and refluxing, acetonitrile which served as a solvent was distilled off under reduced pressure. To the solution, 500 ml of toluene and 6 ml of sulfuric acid were added. While removing generated water, the mixture was heated and refluxed for 2 hours.

After heating and refluxing, the solvent was distilled off under reduced pressure. To the mixture, 1 liter of ethyl acetate was added for extraction and 300 ml of sodium hydrogencarbonate aqueous solution was added for neutralization. In addition, the ethyl acetate layer was three times washed with 300 ml of water. Following this, the layer was dried with magnesium sulfate. Ethyl acetate was distilled off under reduced pressure, and 105.2 g of slight brownish oily crude intermediate (V) was obtained.

<Synthesis of Intermediate (VI)>

To 105.2 g of crude intermediate (V), 600 ml of acetic anhydride was added. After the solution was heated and refluxed for 2 hours, heating and refluxing were continued while removing excessive acetic anhydride. After removing, the resulting solution was cooled to room temperature. To the resulting solution, 300 ml of methanol and 80 ml of concentrated hydrochloric acid were added. The mixture was heated and refluxed for 2 hours, and then cooled to room temperature. Precipitated sulfur was filtrated. The filtrated solution was concentrated under reduced pressure. To the mixture, 500 ml of ethyl acetate was added for extraction and a sodium hydroxide aqueous solution was added for neutralization. The ethyl acetate layer was washed three times with 300 ml of water. Then, the solution was dried with magnesium sulfate. Then, ethyl acetate was distilled off under reduced pressure. Thus, a brownish oily product was obtained. By recrystalizing the compound with acetonitrile, 42.4 g (0.179 mol) of slightly pink crystalized intermediate (VI) was obtained at yield of 51.9% (from intermediate (III)).

<Synthesis of Intermediate (VII)>

To 300 ml of chloroform, 42.0 g (0.178 mol) of intermediate (VI) was dissolved. In an iced water bath, the mixture was stirred at 5° C. To the solution, 22.7 g (0.17 mol) of N-chlorosuccinic acid imide was added gradually for 2 hours. After stirring and addition, the resulting solution was washed three times with 200 ml of water. Following this, the resulting solution was dried with magnesium sulfate, and then, the solvent was distilled off under reduced pressure. The resulting product was recrystalized with a mixed solvent of ethyl acetate and hexane. Thus, 42.0 g (0.155 mol) of white crystalized intermediate (VII) was obtained at yield of 87.7%.

<Synthesis of Exemplified Compound (I)>

To 500 ml of toluene, 151.4 g (0.341 mol) of intermediate (VIII) described in Japanese Patent O.P.I. Publication No. 224369/1993, 10 g of p-toluene sulfonic acid monohydrate and 42.0 g (0.155 mol) of intermediate (VII) were added. While removing water produced, the mixture was heated and refluxed for 8 hours. The resulting solution was washed with 300 ml of water, 300 ml of diluted hydrochloric acid, 300 ml of an sodium hydrogencarbonate aqueous solution and 300 ml of water in this order. Following this, the solution was dried with magnesium sulfate, and the solvent was distilled off under reduced pressure. The resulting product was recrystalized with a mixed solvent of ethyl acetate and hexane so that 76.4 g (0.113 mol) of white solid Exemplified compound (1) was obtained with yield of 72.6%.

Each structure of intermediates and Exemplified compound (1) were confirmed by $^1$HNMR, FD mass-spectral analysis and IR spectral analysis.

It is preferred to contain a magenta coupler applicable to the invention in a silver halide emulsion. The magenta coupler may be contained therein in a well-known method. For example, the magenta coupler relating to the invention can be contained in a silver halide emulsion in the following manner. The magenta coupler relating to the invention is dissolved in a high boiling organic solvent having a boiling point of not lower than 175° C. such as tricresyl phosphate and dibutyl phthalate or a low boiling solvent such as ethyl acetate and butyl propionate independently or, if required, in the mixture thereof independently or in combination, and the resulting solution is mixed with an aqueous gelatin solution containing a surfactant. After that, the resulting mixture is emulsified by making use of a high-speed rotary mixer or a colloid-mill and the emulsified mixture is then added into the silver halide emulsion.

The magenta coupler relating to the invention may usually be used in an amount within the range of $1\times10^{-3}$ to 1 mol and, preferably, $1\times10^{-2}$ to $8\times10^{-1}$ mols per mol of silver halide.

It is also allowed to use the magenta couplers relating to the invention with other kinds of magenta couplers in combination.

It is further allowed to use the magenta couplers relating to the invention with an image stabilizer represented by the following Formula [A] or [B] in combination.

Formula [A]

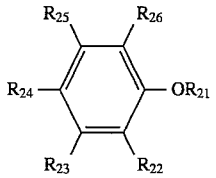

wherein $R_{21}$ represents a hydrogen atom, an alkyl group, an alkenyl group, an aryl group or a heterocyclic group. Among them, the alkyl groups include, for example, the straight-chained or branched alkyl groups such as those of a methyl group, an ethyl group, a propyl group, an n-octyl group, a tert-octyl group, a benzyl group and a hexadecyl group.

The alkenyl groups represented by $R_{21}$ include, for example, an allyl group, a hexenyl group and an octenyl group.

The aryl groups represented by $R_{21}$ include, for example, a phenyl group and a naphthyl group.

The heterocyclic groups represented by $R_{21}$ include, typically, a tetrahydropyranyl group and a pyrimidyl group.

Each of the groups represented by $R_{21}$ include those having a substituent.

In Formula [A], $R_{22}$, $R_{23}$, $R_{25}$ and $R_{26}$ represent each a hydrogen atom, a halogen atom, a hydroxyl group, an alkyl group, an alkenyl group, an aryl group, an alkoxy group or an acylamino group. Among them, the alkyl, alkenyl and aryl groups include each the same alkyl, alkenyl and aryl groups described of $R_{21}$.

The above-mentioned halogen atoms include a fluorine atom, a chlorine atom and a bromine atom.

The above-mentioned alkoxy groups include, typically, a methoxy group, an ethoxy group and a benzyloxy group. Further, the acylamino group is represented by $R_{27}$—CONH— in which $R_{27}$ represents an alkyl group (such as a methyl, ethyl, n-propyl, n-butyl, n-octyl, tert-octyl or benzyl group), an alkenyl group (such as an allyl, octenyl or oleyl group), an aryl group (such as a phenyl, methoxyphenyl or naphthyl group) or a heterocyclic group (such as a pyridinyl or pyrimidyl group).

In the foregoing Formula [A], $R_{24}$ represents an alkyl group, a hydroxyl group, an aryl group, an alkoxy group, an alkenyloxy group or an aryloxy group. Among them, the alkyl and aryl groups include, typically, the same alkyl and aryl groups represented by the foregoing $R_{21}$. And, the alkoxy groups represented by $R_{24}$ include the same alkoxy groups described of the foregoing $R_{22}$, $R_{23}$, $R_{25}$ and $R_{26}$.

In addition, $R_{21}$ and $R_{22}$ may be closed in a ring so as to form a 5- or 6-membered heterocyclic ring, and $R_{23}$ and $R_{24}$ may be closed in a ring so as to form a 5-membered ring. These rings also include those spiro-bonded to other rings.

The typical examples of the compounds represented by the foregoing Formula [A] will now be given below. It is, however, to be understood that the invention shall not be limited thereto.

A-1

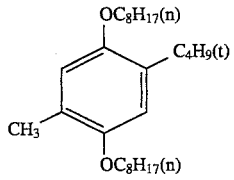

A-2

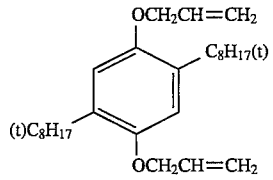

A-3

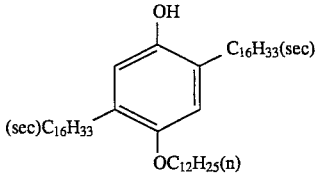

-continued
A-4
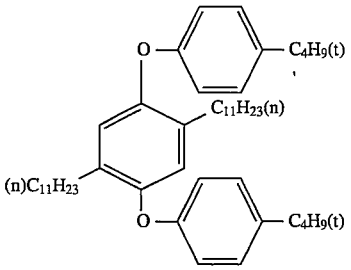
A-5
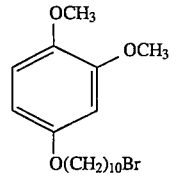
A-6
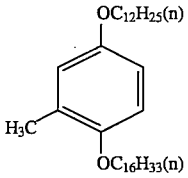
A-7
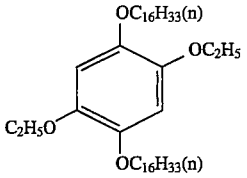
A-8
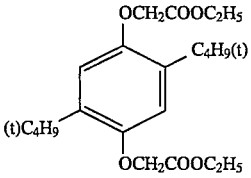
A-9
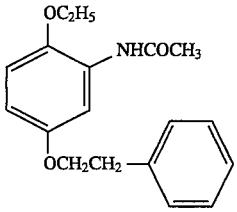
A-10
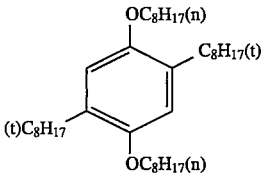
A-11
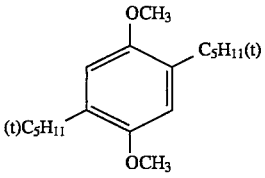
-continued
A-12
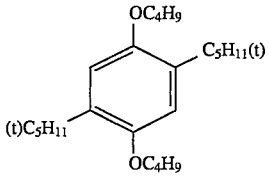
A-13
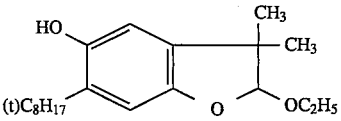
A-14
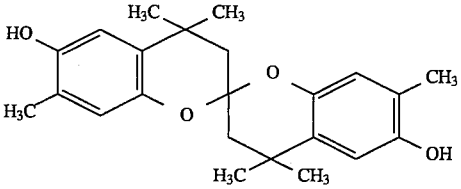
A-15
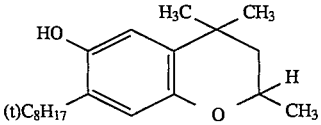
A-16
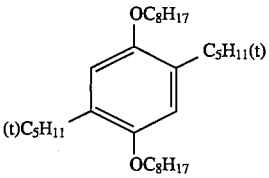
A-17
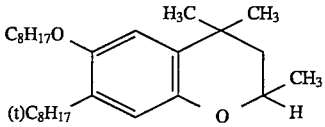
A-18
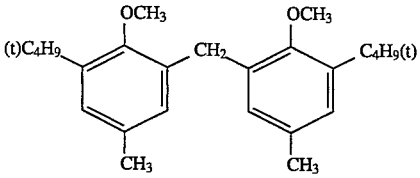
A-19
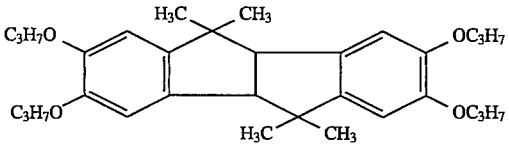
A-20
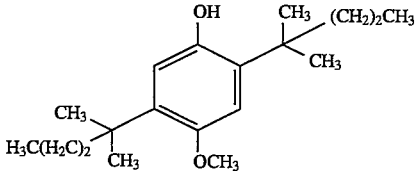

-continued

A-21

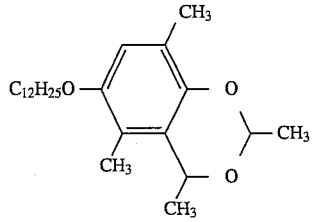

A-22

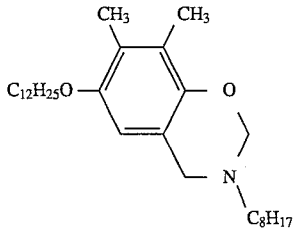

A-23

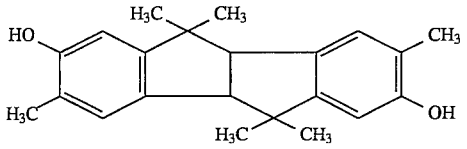

A-24

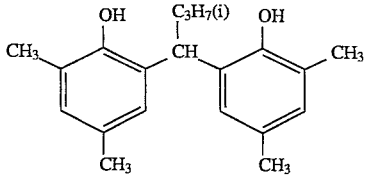

A-25

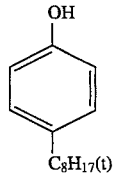

The compounds represented by Formula [A] can readily be synthesized in the procedures described in, for example, 'Journal of the Chemical Society', 1962, pp.415–417; ibid., 1965, pp.2904 to 2914; 'The Journal of Organic Chemistry', Vol.23, pp.75–76; 'Tetrahedron', Vol.26, 1970, pp.4743–4751; 'Chemical Letter', (4), 1972, pp.315–316; 'Bulletin of Chemical Society of Japan' No.10, 1972, pp.1987–1990; and 'Bulletin of Chemical Society of Japan', Vol.53, 1980, pp.555–556.

Formula [B]

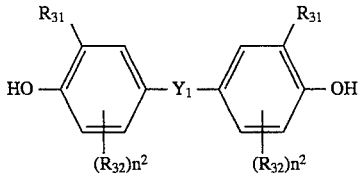

wherein $R_{31}$ represents a secondary or tertiary alkyl group, a secondary or tertiary alkenyl group, a cycloalkyl group or an aryl group; $R_{32}$ represents a halogen atom, an alkyl group, an alkenyl group, a cycloalkyl group or an aryl group; and $n^2$ is an integer of 0 to 3; provided, when two or more each of $R_{31}$ and $R_{32}$ are made present, they may be the same with or the different from each other.

Y represents S, SO, $SO_2$ or an alkylene group.

The secondary or tertiary alkyl groups or the secondary or tertiary alkenyl groups each represented by $R_{31}$ include desirably, those having 3 to 32 carbon atoms and, preferably, those having 4 to 12 carbon atoms. They include, typically, a t-butyl, s-butyl, t-amyl, s-amyl, t-octyl, i-propyl, i-propenyl or 2-hexenyl group.

The alkyl groups represented by $R_{32}$ include, preferably, those having 1 to 32 carbon atoms. The alkenyl groups represented by $R_{32}$ include, preferably, those having 2 to 32 carbon atoms. These groups may be straight-chained or branched and they include, typically, a methyl, ethyl, t-butyl, pentadecyl, 1-hexanonyl, 2-chlorobutyl, benzyl, 2,4 -di-t-amylphenoxymethyl, 1-ethoxytridecyl, allyl or isopropenyl group.

The cycloalkyl groups represented by $R_{31}$ and $R_{32}$ include, preferably, those having 3 to 12 carbon atoms. They include, typically, a cyclohexyl, 1-methylcyclohexyl or cyclopentyl group.

The aryl groups represented by $R_{31}$ and $R_{32}$ include, preferably, a phenyl group and a naphthyl group. They include, typically, a phenyl, 4-nitrophenyl, 4-t-butylphenyl, 2,4-di-t-amylphenyl, 3-hexadecyloxyphenyl or α-naphthyl group.

The alkylene groups represented by $Y_1$ include, preferably, those having 1 to 12 carbon atoms. They include, typically, a methylene, ethylene, propylene or hexamethylene group.

Each of the groups represented by the above-mentioned $R_{31}$, $R_{32}$ and $Y_1$ are each also allowed to have a substituent.

The substituents $R_{31}$, $R_{32}$ and $Y_1$ are each allowed to have include, for example, a halogen atom and a nitro, cyano, sulfonamido, alkoxy, aryloxy, alkylthio, arylthio or acyl group.

The typical examples of the compounds represented by Formula [B] will be given below. It is, however, to be understood that the invention shall not be limited thereto.

B-1

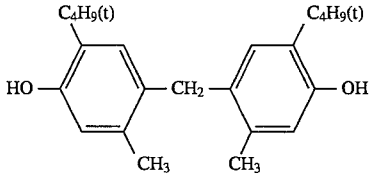

B-2

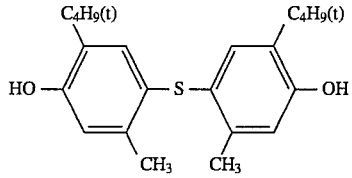

B-3

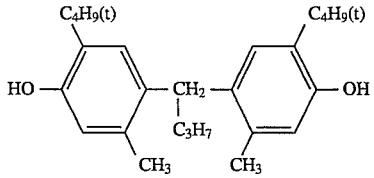

B-4

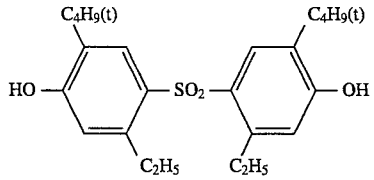

-continued

B-5

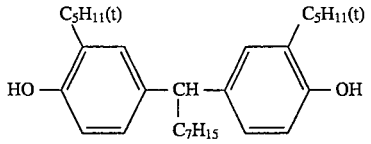

B-6

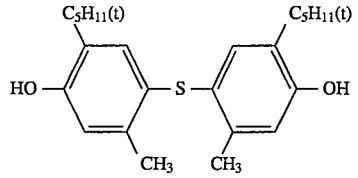

B-7

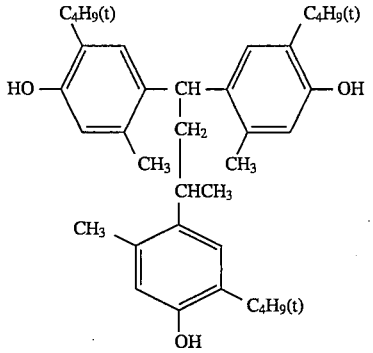

B-8

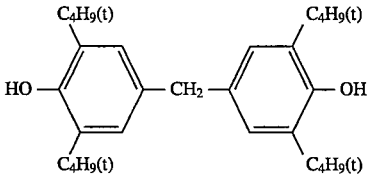

B-9

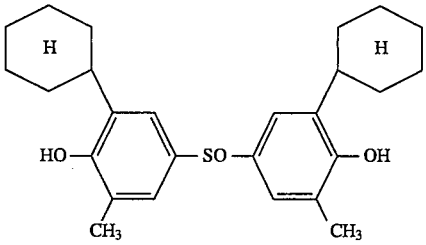

B-10

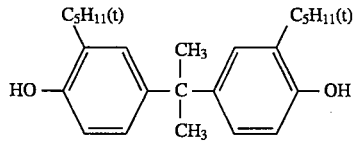

B-11

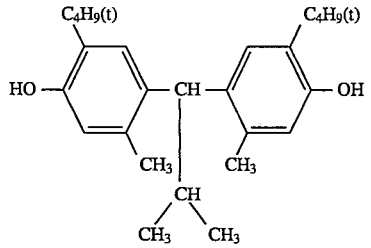

-continued

B-12

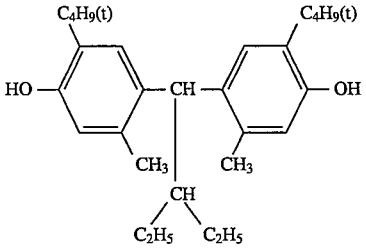

The compounds represented by Formula [B] can readily be synthesized in the procedures described in, for example, U.S. Pat. No. 2,807,653, 'Journal of the Chemical Society', Perkin I, 1979, p.1712.

The image stabilizers represented by the foregoing Formulas [A] and [B] may be used in an amount within the range of, desirably, 5 to 400 mol % and, preferably, 10 to 250 mol % of the pyrazoloazole type magenta couplers relating to the invention.

It is preferable that the pyrazoloazole type magenta couplers of the invention and the above-mentioned image stabilizers are used in one and the same layer. It is, however, allowed to use the image stabilizers in the layer adjacent to a layer containing the above-mentioned couplers.

The silver halides preferably used in the invention are comprised of silver chloride, silver chlorobromide or silver chloroiodobromide and, further, they may also be comprised of a combined mixture such as the mixture of silver chloride and silver bromide.

In the silver halide emulsions applicable to the invention, it is allowed to use any one of silver halides such as silver bromide, silver iodobromide, silver iodochloride, silver chlorobromide, silver chloroiodobromide and silver chloride, provided, they can be used in ordinary silver halide emulsions.

The silver halide grains may be either those having the uniform distribution of silver halide compositions inside the grains or those of the core/shell type having the different silver halide compositions between the inside of the grains and the surface layers of the grains.

The silver halide grains may be either those capable of forming a latent image mainly on the surfaces thereof or those capable of forming a latent image mainly inside the grains thereof.

The silver halide grains may be either those having a regular crystal form such as a cube, octahedron or tetradecahedron or those having an irregular crystal form such as a globular or tabular form. It is allowed to use the grains having any ratios of {100} planes to {111} planes.

These grains may also have a mixed crystal form or may be mixed with the grains having various crystal forms.

The silver halide grains applicable there to are to have a grain size within the range of, desirably, 0.05 to 30 μm and, preferably, 0.1 to 20 μm.

The silver halide emulsions having any grain size distributions may be used. It is, therefore, allowed to use either the emulsions having a wide grain size distribution (hereinafter referred to as 'polydisperse type emulsions') or the independent or mixed emulsions having a narrow grain size distribution (hereinafter referred to as 'monodisperse type emulsions'). It is, further, allowed to use the mixtures of the polydisperse type and monodisperse type emulsions. The couplers applicable to the invention include a colored coupler capable of displaying a color compensation effect and the compounds capable of releasing a photographically useful fragment such as a development retarder, a development accelerator, a bleach accelerator, a developing agent, a silver halide solvent, a color toner, a layer hardener, a foggant, an antifoggant, a chemical sensitizer, a spectral sensitizer and a desensitizer. Among these compounds, it is also allowed to use the so-called DIR compounds capable of releasing a development retarder in the course of carrying out a development and improving the sharpness and graininess of an image.

The above-mentioned DIR compounds include those containing a retarder directly coupled to the coupling position thereof and those containing a retarder coupled to the coupling position through a divalent group and capable of releasing the retarder either upon intramolecular nucleophilic reaction or upon intramolecular electron-transfer reaction, produced in a group split off upon coupling reaction, (the latter compounds are hereinafter referred to as 'timing DIR compounds'). The retarders applicable thereto include those becoming diffusible upon splitting off and those not having a diffusibility so much, independently or in combination so as to meet the purposes of application.

The above-mentioned couplers are to make a coupling reaction with the oxidized products of an aromatic primary amine developing agent and these couplers may also be used in combination with a colorless coupler not forming any dyes (hereinafter referred to as 'competing coupler') as a dye-forming coupler.

The yellow couplers preferably applicable to the invention include, for example, the well-known acylacetanilide type couplers. Among these couplers, benzoyl acetanilide type and pivaloyl acetanilide type compounds may advantageously be used.

The cyan couplers preferably applicable to the invention include, for example, phenol type and naphthol type couplers.

It is also allowed to use a color-fog inhibitor for the purposes of preventing a color stain, a sharpness deterioration and/or a rough graininess, which may be produced by transferring the oxidized products of an developing agent or an electron transferrer between the emulsion layers of a light sensitive material (i.e., between the same color-sensitive layers and/or between the different color-sensitive layers).

An image stabilizer capable of preventing the deterioration of a dye image may be applied to the light sensitive materials of the invention. The compounds preferably applicable thereto are described in, for example, RD 17643, Article VII-J.

For the purposes of preventing any fog from being produced by a electric discharge generated by frictionally static-charging a light sensitive material and preventing an image from being deteriorated by UV rays, a UV absorbent may also be contained in the hydrophilic colloidal layers thereof such as the protective layers and interlayers.

For the purpose of preventing a magenta-dye forming coupler from being deteriorated by formalin in the course of preserving a light sensitive material, a formalin scavenger may further be used in the light sensitive material.

The invention can preferably be applied to a color negative film, a color paper, a color reversal film and so forth.

Now, the invention will be detailed with reference to the following preferred embodiments. It is, however, to be understood that the embodiments of the invention shall not be limited thereto.

EXAMPLE 1

Sample 101 of multilayered silver halide color photographic light sensitive materials was prepared in the following manner. Over to a polyethylene-laminated paper support containing polyethylene on one side thereof and titanium oxide on the other side thereof, each of the layers having the compositions shown in the following Tables 1 and 2 were coated thereover on the side of the polyethylene layer containing titanium oxide.

TABLE 1

| Layer | Composition | Coating weight ($g/m^2$) |
|---|---|---|
| 7th layer (Protective layer) | Gelatin | 1.00 |
| 6th layer (UV abosorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistaining agent (HQ-1) | 0.01 |
| | DNP | 0.20 |
| | PVP | 0.03 |
| | Anti-irradiation dye (AIC-1) | 0.02 |
| 5th layer (Res-sensitive layer) | Gelatin | 1.30 |
| | Red-sensitive silver chlorobromide emulsion (Em-R) | 0.21 |
| | Cyan coupler (EC-1) | 0.24 |
| | Cyan coupler (EC-2) | 0.08 |
| | Dye-image stabilizer (ST-1) | 0.20 |
| | Antistaining agent (HQ-1) | 0.01 |
| | HBS-1 | 0.20 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-1) | 0.03 |
| | DNP | 0.40 |
| 3rd layer (Green-sensitive layer) | Gelatin | 1.40 |
| | Green-sensitive silver chlorobromide emulsion (Em-G) | 0.17 |
| | Magenta coupler (EM-1) | 0.75* |
| | DNP | 0.20 |
| | Anti-irradiation dye (AIM-1) | 0.01 |
| 2nd layer (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |

TABLE 2

| Layer | Composition | Coating weight ($g/m^2$) |
|---|---|---|
| 1st layer (Blue-sensitive layer) | Gelatin | 1.20 |
| | Blue-sensitive silver chlorobromide emulsion (Em-B) | 0.26 |
| | Yellow coupler (EY-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AIY-1) | 0.01 |
| | DNP | 0.20 |
| Support | Polyethylene-laminated paper sheet | |

*milli-mol/$m^2$

Amounts of the silver halide emulsions added were each shown in terms of the silver contents.

The coating solutions were each prepared in the following manner.

Coating Solution for the 1st Layer

Ethyl acetate of 60 cc was added and dissolved into 26.7 g of yellow coupler (EY-1), 10.0 g of dye-image stabilizer (ST-1), 6.67 g of a dye-image stabilizer (ST-2), 0.67 g of antistaining agent (HQ-1) and 6.67 g of high-boiling organic solvent (DNP). The resulting solution was emulsified and dispersed in 220 cc of 10% gelatin aqueous solution containing 7 cc of 20% surfactant (SU-2) aqueous solution by making use of a supersonic homogenizer, so that a yellow coupler dispersed solution could be prepared.

The resulting dispersed solution was mixed with the following blue-sensitive silver halide emulsion (containing 8.67 g of silver) and antiirradiation dye (AIY-1) was further added thereto, so that the coating solution for the 1st layer could be prepared.

The coating solutions for the 2nd through 7th layers were also prepared in the same manner as in the above-mentioned coating solution for the 1st layer. Besides, for the layer hardeners, (HH-1) were each added to the 2nd and 4th layers and (HH-2) to the 7th layer, respectively. For the coating aids, surfactants (SU-1) and (SU-3) were each added thereto so that the surface tension of each layer could be controlled.

The chemical structures of the compounds applied to each of the above-mentioned layers were as follows.

EY-1

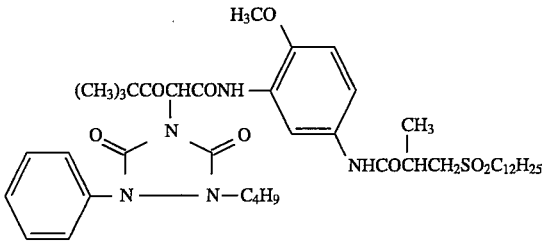

EC-1

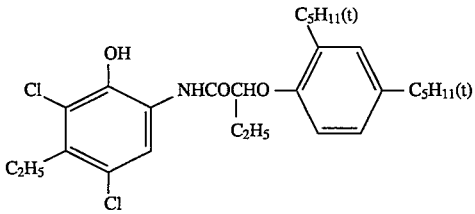

EC-2

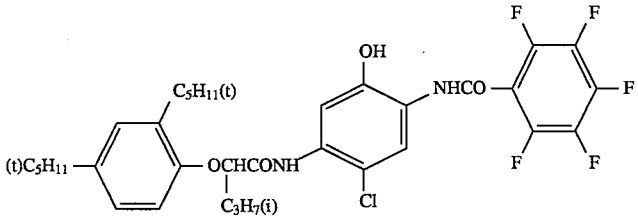

ST-1

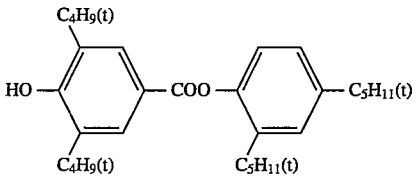

ST-2

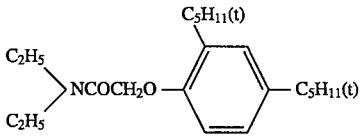

ST-3

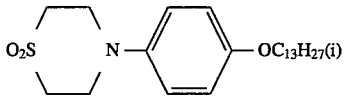

-continued
ST-4
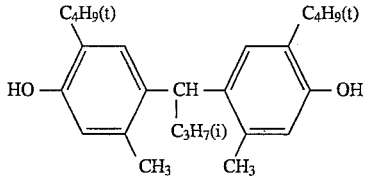
(Compounds described in Japanese Patent O.P.I. Publication No. 224369/1993)
ST-5
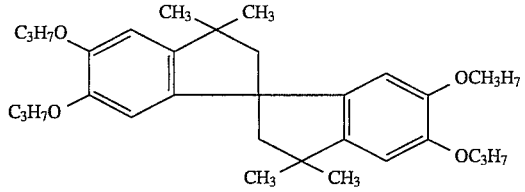
(A compound described in Japanese Patent O.P.I. Publication No, 224369/1993
EM-1
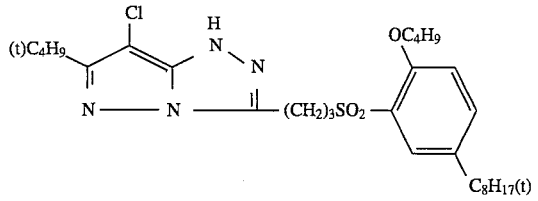
EM-2
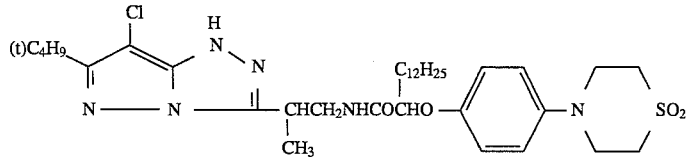
(A compound described in Japanese Patent O.P.I. Publication No. 67142/1992
EM-3
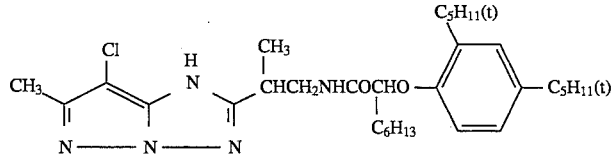
UV-1
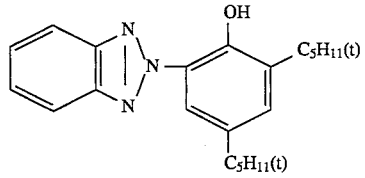
UV-2
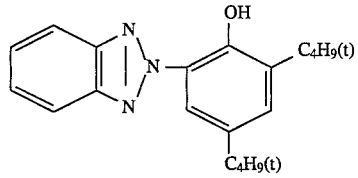
UV-3
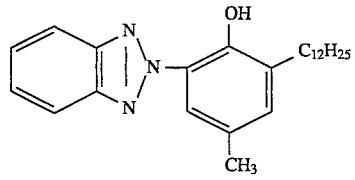
DOP = Dioctyl phthalate -continued
DNP = Dinonyl phthalate
DIDP = Diisodecyl phthalate
PVP = Polyvinyl pyrrolidone
HQ-1
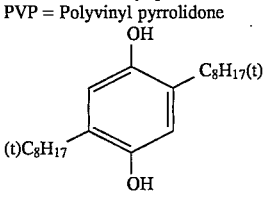
HQ-2
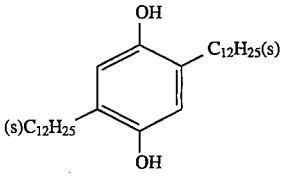
HQ-3
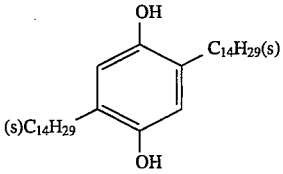
HQ-4
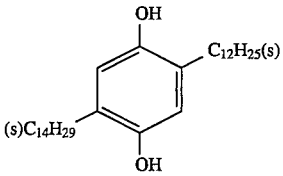
HQ-5
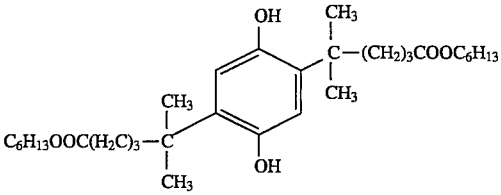
HBS-1
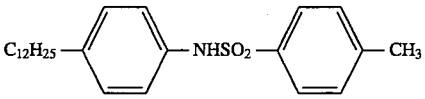
AIM-1
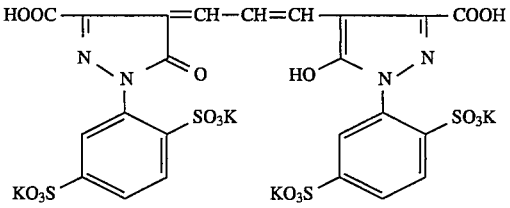
AIC-1
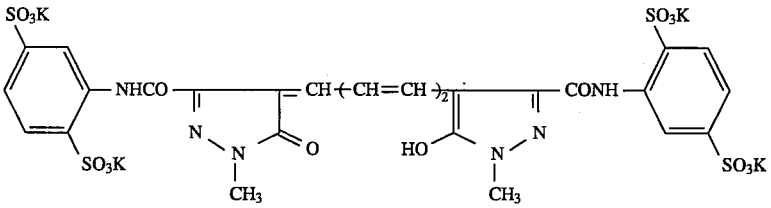

-continued

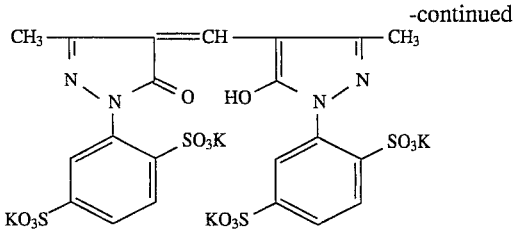

AIY-1

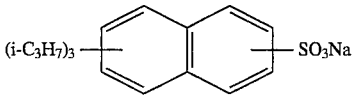

SU-1

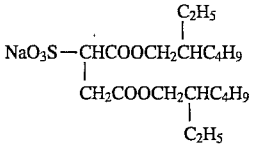

SU-2

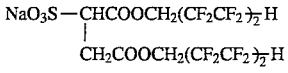

SU-3

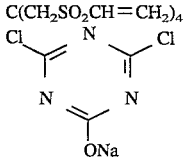

HH-1
HH-2

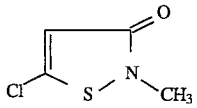

F-1

Silver halide emulsions used for the 1st layer, the 3rd layer and the 5th layer are as follows:

Blue-Sensitive Silver Halide Emulsion (Em-B)

This was a monodisperse type cubic silver chlorobromide emulsion having an average grain size of 0.85 μm, a variation coefficient of 0.07 and a silver chloride content of 99.5 mol %.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Green-sensitive silver halide emulsion (Em-G)

This was a monodisperse type cubic silver chlorobromide emulsion having an average grain size of 0.43 μm, a variation coefficient of 0.08 and a silver chloride content of 99.5 mol %.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

-continued

Red-sensitive silver halide emulsion (Em-R)

This was a monodisperse type cubic silver chlorobromide emulsion having an average grain size of 0.50 μm, a variation coefficient of 0.08 and a silver chloride content of 99.5 mol %.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

The chemical structures of the compounds applied to each of the monodiserse type cubic emulsions were as follows.

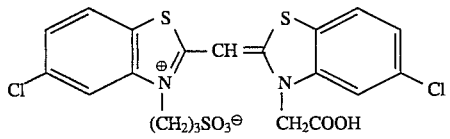

BS-1

-continued

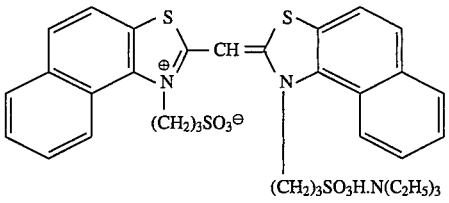

BS-2

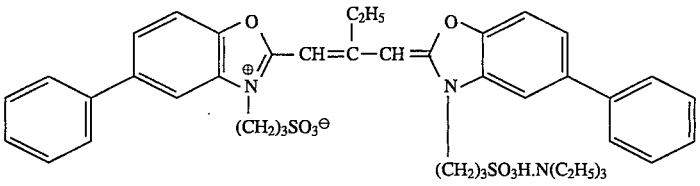

GS-1

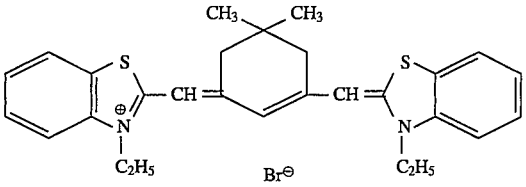

RS-1

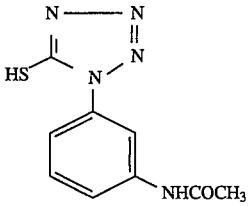

STAB-1

Next, Samples 102 through 128 were each prepared in the same manner as in Sample 101, except that the coupler EM-1 of the 3rd layer was replaced by the same mols of the coupler of the invention shown in the following Table-3 and the dye-image stabilizer was replaced by those shown in Table-3, respectively.

The chemical structures of the magenta couplers EM-2, EM-3 and EM-4 each applied to the comparative samples are shown together with the chemical structure of the foregoing EM-1.

The resulting samples were each exposed to green light through a wedge in an ordinary procedures and they were then processed in the following processing steps.

| Processing step | Temperature | Time |
|---|---|---|
| Color developing | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

The compositions of each of the processing solution will be given below.

The processing solutions were each replenished in an amount of 80 cc per $m^2$ of a subject silver halide color photographic light sensitive material.

| Color developer | Tank solution | Replenishing solution |
|---|---|---|
| Pure water | 800 cc | 800 cc |
| Triethanol amine | 10 g | 18 g |
| N,N-diethyl hydroxyl amine | 5 g | 9 g |

-continued

| Color developer | Tank solution | Replenishing solution |
|---|---|---|
| Potassium chloride | 2.4 g | |
| 1-hydroxyethylidene-1,1-diphosphonic acid | 1.0 g | 1.8 g |
| N-ethyl-N-β-methanesulfonamidoethyl-3-methyl-4-aminoaniline sulfate | 5.4 g | 8.2 g |
| Fluorescent whitening agent, (a 4,4'-diaminostilbene sulfonic acid derivative) | 1.0 g | 1.8 g |
| Potassium carbonate | 27 g | 27 g |
| Add water to make in total of 1000 cc | | |

Adjust pH values of the tank solution to be 10.0 and of the replenisher to be 10.60, respectively.

| Bleach-fixer (The same in both of the tank solution and the replenishing solution) | |
|---|---|
| Ferric ammonium ethylenediamine tetraacetate, dihydrate | 60 g |
| Ethylenediaminetetraacetic acid | 3 g |
| Ammonium thiosulfate (in an aqueous 70% solution) | 100 cc |
| Ammonium sulfite (in an aqueous 40% solution) | 27.5 cc |
| Add water to make in total of | 1000 cc |
| Adjust pH with potassium carbonate or glacial acetic acid to be | pH 5.7 |
| Stabilizer (The same in both of the tank solution and the replenisher) | |
| 5-chloro-2-methyl-4-isothiazoline-3-one | 1.0 g |
| Ethylene glycol | 1.0 g |
| 1-hydroxyethylidene-1,1- | 2.0 g |

-continued

| | |
|---|---|
| diphosphonic acid | |
| Ethylenediaminetetraacetic acid | 1.0 g |
| Ammonium hydroxide (in an aqueous 20% solution) | 3.0 g |
| Fluorescent whitening agent (a 4,4'-diaminostilbene sulfonic acid derivative) | 1.5 g |
| Add water to make in total of | 1000 cc |
| Adjust pH with sulfuric acid or potassium hydroxide to be | pH 7.0 |

The following evaluation were each carried out by making use of the samples which were continuously processed.

<Dmax>

The maximum color densities thereof were measured.

<Light-Fastness>

The resulting samples were each exposed to a Xenon fadometer for 7 days and the dye image residual percentage (%) thereof at the initial density of 1.0 were found out.

The results thereof are shown in Table 3.

TABLE 3

| Sample No. | Magenta coupler in the 3rd layer | Dmax | Dye image residual ratio (%) |
|---|---|---|---|
| 101 (Comp) | EM-1 | 1.96 | 32 |
| 102 (Comp) | EM-2 | 2.33 | 68 |
| 103 (Inv) | (1) | 2.47 | 81 |
| 104 (Inv) | (2) | 2.43 | 73 |
| 105 (Inv) | (3) | 2.49 | 83 |
| 106 (Inv) | (8) | 2.44 | 80 |
| 107 (Inv) | (24) | 2.47 | 85 |
| 108 (Comp) | EM-3 | 2.01 | 29 |
| 109 (Inv) | (32) | 2.36 | 76 |
| 110 (Inv) | (34) | 2.34 | 75 |

As is apparent from Table 3, Samples 103 through 107 and Samples 109 through 110 each using the magenta coupler of the present invention is excellent in terms of Dmax and light-fastness due to effects caused by alkyl group branching at the root of the ballast group compared to comparative example Nos. 101, 102 and 108.

EXAMPLES 1–2

Sample Nos. 111 to 130 were prepared by adding dye image stabilizers as shown in the following Table 4 each having the equivalent mol to that of the magenta coupler in the 3rd layer of Sample No. 101 in Example 1.

By the use of the resulting samples, the same evaluation as Example 1 was conducted. Table 4 shows the results thereof.

TABLE 4

| Sample No | Magenta coupler in the 3rd layer | Dye image stabilizer | Dmax | Dye image density residual ratio (%) |
|---|---|---|---|---|
| 111 (Comp) | EM-1 | ST-3, ST-4 | 2.08 | 70 |
| 112 (Comp) | EM-1 | ST-3, ST-4 | 2.04 | 68 |
| 113 (Comp) | EM-2 | ST-4 | 2.37 | 77 |
| 114 (Comp) | EM-2 | ST-5 | 2.34 | 76 |
| 115 (Inv) | (1) | ST-4 | 2.49 | 85 |
| 116 (Inv) | (1) | ST-5 | 2.48 | 85 |
| 117 (Inv) | (2) | ST-4 | 2.48 | 82 |
| 118 (Inv) | (2) | ST-5 | 2.48 | 81 |
| 119 (Inv) | (3) | ST-4 | 2.50 | 89 |
| 120 (Inv) | (3) | ST-5 | 2.49 | 86 |
| 121 (Inv) | (8) | ST-4 | 2.45 | 82 |
| 122 (Inv) | (8) | ST-5 | 2.44 | 81 |

TABLE 4-continued

| Sample No | Magenta coupler in the 3rd layer | Dye image stabilizer | Dmax | Dye image density residual ratio (%) |
|---|---|---|---|---|
| 123 (Inv) | (24) | ST-4 | 2.51 | 88 |
| 124 (Inv) | (24) | ST-5 | 2.50 | 87 |
| 125 (Comp) | EM-3 | ST-3, ST-4 | 2.04 | 69 |
| 126 (Comp) | EM-3 | ST-3, ST-5 | 2.08 | 72 |
| 127 (Inv) | (32) | ST-4 | 2.39 | 78 |
| 128 (Inv) | (32) | ST-5 | 2.41 | 77 |
| 129 (Inv) | (34) | ST-4 | 2.38 | 77 |
| 130 (Inv) | (34) | ST-5 | 2.41 | 78 |

As is apparent from Table 4, in the samples wherein the dye image stabilizer is added too, Sample Nos. 115 to 124 and 127 to 130 each using the magenta couplers of the present invention are superior to Comparative example Nos. 111 through 114 and 125 through 126 in terms of Dmax and light-fastness. In addition, when comparing to Sample Nos. 101 through 110 shown in Table 3, it can be understood that both of sensitive property and light-fastness were improved due to the presence of the dye image stabilizer.

EXAMPLE 3

Reflection spectral light-absorption spectra of Sample Nos. 101 to 110 in Example 1 were measured so that the spectral absorption characteristics were evaluated by means of λmax and Abs.600.

λmax: represents the maximum absorption wavelength of a wedge at the reflection optical density of 1.0.

Abs.600: represents the absorption degree at 600 nm of the wedge at the reflection optical density of 1.0.

TABLE 5

| Sample No. | Magenta coupler in the 3rd layer | λmax (nm) | Abs. 600 |
|---|---|---|---|
| 101 (Comp) | EM-1 | 547 | 0.44 |
| 102 (Comp) | EM-2 | 548 | 0.40 |
| 103 (Inv) | (1) | 548 | 0.34 |
| 104 (Inv) | (2) | 547 | 0.35 |
| 105 (Inv) | (3) | 548 | 0.35 |
| 106 (Inv) | (8) | 549 | 0.36 |
| 107 (Inv) | (24) | 548 | 0.34 |
| 108 (Comp) | EM-3 | 546 | 0.43 |
| 109 (Inv) | (32) | 547 | 0.38 |
| 110 (Inv) | (34) | 548 | 0.39 |

As is apparent from Table 5, in Sample Nos. 103 to 107 and 109 to 110 each employing the magenta coupler of the present invention, the absorption degree at 600 nm was decreased (in other words, absorption has become sharp) compared to Sample Nos. 101, 102 and 108 each using comparative couplers, thus, color reproducibility has been improved.

EXAMPLE 4

On one side of a triacetylcellulose film support, subbing was provided. On a side opposite to the surface of the support (the reverse surface), layers having the following composition were formed successively in that order from the support side.

Incidentally, the amount added in the silver halide photographic light-sensitive material was described in terms of an amount per 1 $m^2$. In addition, silver halide and colloidal silver were described after being converted to silver.

| Backside surface 1st layer | |
|---|---|
| Aluminasol AS-100 (aluminum oxide) (produced by Nissan Kagaku Co. Ltd.) | 0.8 g |
| **Backside surface 2nd layer** | |
| Diacetylcellulose | 100 mg |
| Stearic acid | 10 mg |

-continued

| | |
|---|---|
| Silica fine particle (average particle size is 0.2 μm) | 50 mg |

On the surface of a triacetylcellulose provided with subbing treatment, layers having the following compositions were formed in this order from the support so that a multilayered color photographic light-sensitive material was prepared.

| | |
|---|---|
| **1st layer; Anti-halation layer (HC)** | |
| Black colloidal silver | 0.15 g |
| UV absorber (UV-1) | 0.20 g |
| Colored cyan coupler (CC-1) | 0.02 g |
| High boiling solvent (Oil-1) | 0.20 g |
| High boiling solvent (Oil-2) | 0.20 g |
| Gelatin | 1.6 g |
| **2nd layer; Intermediate layer (IL-1)** | |
| Gelatin | 1.3 g |
| **3rd layer; Low sensitive red sensitivity emulsion layer (R-L)** | |
| Silver bromoiodide emulsion (average grain size is 0.3 μm) (average iodide content is 2.0 mol %) | 0.4 g |
| Silver bromoiodide emulsion (average grain size is 0.4 μm) (average iodide content is 8.0 mol %) | 0.3 g |
| Sensitizing dye (S-1) | $3.2 \times 10^{-4}$ (mol/mol of silver) |
| Sensitizing dye (S-2) | $3.2 \times 10^{-4}$ (mol/mol of silver) |
| Sensitizing dye (S-3) | $0.2 \times 10^{-4}$ (mol/mol of silver) |
| Cyan coupler (C-1) | 0.50 g |
| Cyan coupler (C-2) | 0.13 g |
| Colored cyan coupler (CC-1) | 0.07 g |
| DIR compound (D-1) | 0.006 g |
| DIR compound (D-2) | 0.01 g |
| High boiling solvent (Oil-1) | 0.55 g |
| Gelatin | 1.0 g |
| **4th layer; High sensitive red sensitivity emulsion layer (R-H)** | |
| Silver bromoiodide emulsion (average grain size is 0.7 μm) (average iodide content amount is 7.5 mol %) | 0.9 g |
| Sensitizing dye (S-1) | $1.7 \times 10^{-4}$ (mol/mol of silver) |
| Sensitizing dye (S-2) | $1.6 \times 10^{-4}$ (mol/mol of silver) |
| Sensitizing dye (S-3) | $0.1 \times 10^{-4}$ (mol/mol of silver) |
| Cyan coupler (C-2) | 0.23 g |
| Colored cyan coupler (CC-1) | 0.03 g |
| DIR compound (D-2) | 0.02 g |
| High boiling solvent (Oil-1) | 0.25 g |
| Gelatin | 1.0 g |
| **5th layer; Intermediate layer (IL-2)** | |
| Gelatin | 0.8 g |
| **6th layer; Low sensitive green sensitivity emulsion layer (G-L)** | |
| Silver bromoiodide emulsion (average grain size is 0.4 μm) (average iodide content is 8.0 mol %) | 0.6 g |
| Silver bromoiodide emulsion (average grain size is 0.3 μm) (average iodide content is 2.0 mol %) | 0.2 g |
| Sensitizing dye (S-4) | $6.7 \times 10^{-4}$ (mol/mol of silver) |
| Sensitizing dye (S-5) | $0.8 \times 10^{-4}$ (mol/mol of silver) |
| Magenta coupler (M-1) | 0.45 g |
| Colored magenta coupler (CM-1) | 0.10 g |
| DIR compound (D-3) | 0.02 g |
| High boiling solvent (Oil-2) | 0.7 g |
| Gelatin | 1.0 g |
| **7th layer; High sensitive red sensitivity emulsion layer (G-H)** | |
| Silver bromoiodide emulsion (average grain size is 0.7 μm) (average iodide content is 7.5 mol %) | 0.9 g |
| Sensitizing dye (S-6) | $1.1 \times 10^{-4}$ (mol/mol of silver) |
| Sensitizing dye (S-7) | $2.0 \times 10^{-4}$ (mol/mol of silver) |
| Sensitizing dye (S-8) | $0.3 \times 10^{-4}$ (mol/mol of silver) |
| Magenta coupler (M-1) | 0.35 g |
| Colored cyan coupler (CM-1) | 0.04 g |
| DIR compound (D-3) | 0.004 g |
| High boiling solvent (Oil-2) | 0.35 g |
| Gelatin | 1.0 g |

-continued

| | |
|---|---|
| 8th layer; Yellow filter layer (YC) | |
| Yellow colloidal layer | 0.1 g |
| Additive (HS-1) | 0.07 g |
| Additive (HS-2) | 0.07 g |
| Additive (SC-1) | 0.12 g |
| High boiling solvent (Oil-2) | 0.15 g |
| Gelatin | 1.0 g |
| 9th layer; Low sensitive blue sensitivity emulsion layer (B-L) | |
| Silver bromoiodide emulsion (average grain size is 0.3 μm) (average iodide content is 2.0 mol %) | 0.25 g |
| Silver bromoiodide emulsion (average grain size is 0.4 μm) (average iodide content is 8.0 mol %) | 0.25 g |
| Sensitizing dye (S-9) | $5.8 \times 10^{-4}$ (mol/mol of silver) |
| Yellow coupler (Y-1) | 0.6 g |
| Yellow coupler (Y-2) | 0.32 g |
| DIR compound (D-1) | 0.003 g |
| DIR compound (D-2) | 0.006 g |
| High boiling solvent (Oil-2) | 0.18 g |
| Gelatin | 1.3 g |
| 10th layer; High sensitive blue sensitivity emulsion layer (B-H) | |
| Silver bromoiodide emulsion (average grain size is 0.8 μm) (average iodide content is 8.5 mol %) | 0.5 g |
| Sensitizing dye (S-10) | $3 \times 10^{-4}$ (mol/mol of silver) |
| Sensitizing dye (S-11) | $1.2 \times 10^{-4}$ (mol/mol of silver) |
| Yellow coupler (Y-1) | 0.18 g |
| Yellow coupler (Y-2) | 0.10 g |
| High boiling solvent (Oil-2) | 0.05 g |
| Gelatin | 1.0 g |
| 11th layer; 1st protective layer (PRO-1) | |
| Silver bromoiodide (average grain size is 0.08 μm) | 0.3 g |
| UV-absorber (UV-1) | 0.07 g |
| UV-absorber (UV-2) | 0.10 g |
| Additive (HS-1) | 0.2 g |
| Additive (HS-2) | 0.1 g |
| High boiling solvent (Oil-1) | 0.07 g |
| High boiling solvent (Oil-3) | 0.07 g |
| Gelatin | 0.8 g |
| 12th layer; 2nd protective layer (PRO-2) | |
| Compound A | 0.04 g |
| Compound B | 0.004 g |
| Polymethylmethacrylate (average particle size is 3 μm) | 0.02 g |
| Copolymer wherein methylmethaacrylate: ethylmethaacrylate : methaacrylic acid = 3:3:4 (by weight) (average particle size is 3 μm) | 0.13 g |

Incidentally, the above-mentioned light-sensitive material 101 contains compounds SU-1 and SU-2, a viscosity regulator, hardeners H-1 and H-2, stabilizer ST-1, antifoggants AF-1 and AF-2 (whose weight average molecular weight are respectively 10,000 and 1,100,000), dyes AI-1, AI-2 and DI-1 (9.4 g/m$^2$).

The silver bromoiodide emulsion in the 10th layer was prepared by the following method.

With a mono-dispersed silver bromoiodide grain having an average grain size of 0.33 μm (silver iodide content of 2 mol %) as a seed crystal, the silver bromoiodide emulsion was prepared by the use of a double jet method.

While solution <G-1> kept at 70° C., pAg 7.8 and pH 7.0 was stirred completely, the seed emulsion equivalent to 0.34 mol was added thereto.

(Formation of an Inner High Iodide Content Phase—the Shell Phase)

Following the above, while keeping the flow rate ratio of <H-1> to <S-1> at 1:1, addition of the seed emulsion was continued for 86 minutes, in which the flow rate was gradually enhanced (the last flow rate was 3.6 times the initial flow rate).

(Formation of an Outer Low Iodide Content Phase—the Shell Phase)

Following this, while keeping pAg 10.1 and pH 6.0 and the flow rate ratio of <H-2> and <S-2> at 1:1, addition of the seed emulsion was continued for 65 minutes, in which the flow rate was gradually enhanced (the last flow rate was 5.2 times the initial flow rate).

During the formation of grains, pAg and pH were controlled by the use of potassium bromide aqueous solution and a 56% acetic acid aqueous solution. After the formation of grains, the grains were washed with water by a conventional flocculation method. Following this, gelatin was added thereto and for re-dispersion. At 40° C., the pH and pAg were respectively regulated to 5.8 and 8.06.

The resulting emulsion was a mono-dispersed emulsion containing an octahedral silver bromoiodide grains wherein an average grain size was 0.80 μm, the width of grain size distribution was 12.4% and the silver iodide content was 8.5 mol %.

| <G-1> | |
|---|---|
| Osein gelatin | 100.0 g |
| Compound I (10% methanol solution by weight) | 25.0 ml |

| | |
|---|---|
| Ammonia (28% aqueous solution by weight) | 440.0 ml |
| Acetic acid (56% aqueous solution by weight) | 660.0 ml |
| Add water to make 5000.0 ml in total. | |

<H-1>

| | |
|---|---|
| Osein gelatin | 82.4 g |
| Potassium bromide | 151.6 g |
| Potassium iodide | 90.6 g |
| Add water to make 1030.5 ml in total. | |

<S-1>

| | |
|---|---|
| Silver nitrate | 309.2 g |
| Ammonia (28% aqueous solution by weight) | Equivalent |
| Add water to make 1030.5 ml in total. | |

<H-2>

| | |
|---|---|
| Osein gelatin | 302.1 g |
| Potassium bromide | 770.0 g |
| Potassium iodide | 33.2 g |
| Add water to make 3776.8 ml in total. | |

<S-2>

| | |
|---|---|
| Silver nitrate | 1133.0 g |
| Ammonia (28% aqueous solution by weight) | Equivalent |
| Add water to make 3776.8 ml in total. | |

In the same manner as above, the average grain size of seed crystal, temperature, pAg, pH, flow rate, addition time and halide composition were changed so that the above-mentioned emulsions having different average grain size and silver iodide content were prepared. All emulsions were a core/shell type mono-dispersed emulsion wherein the variation coefficient of grain size distribution was 20% or less.

Each emulsion was subjected to the optimum chemical ripening in the presence of sodium thiosulfate, chloroaurate and ammonium thiocyanate wherein a sensitizing dye, 4-hydroxy- 6-methyl-1,3,3a,7-tetrazaindene and 1-phenyl-5-mercapto tetrazole were added.

C-1

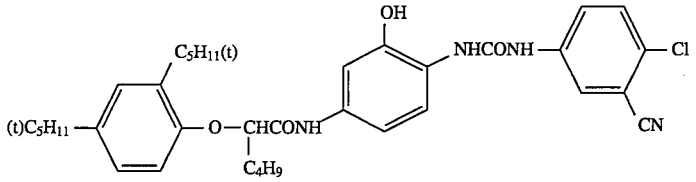

C-2

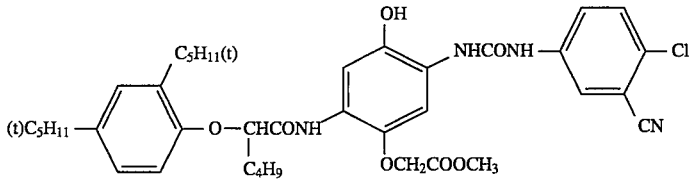

M-1

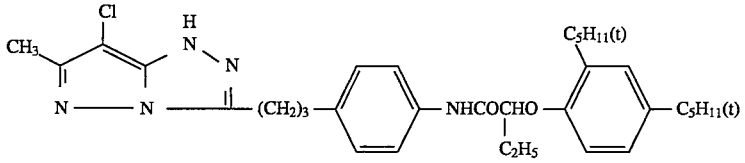

Y-1

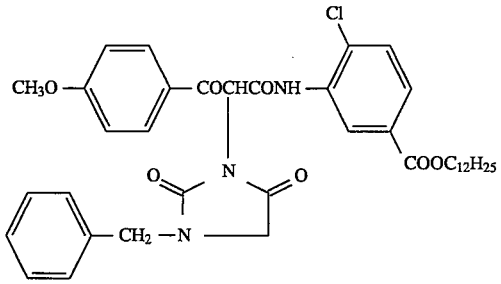

Y-2

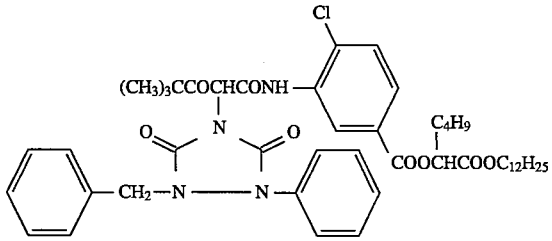

-continued
CC-1
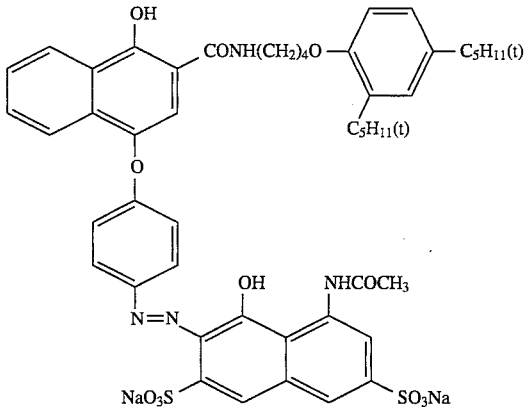
CM-1
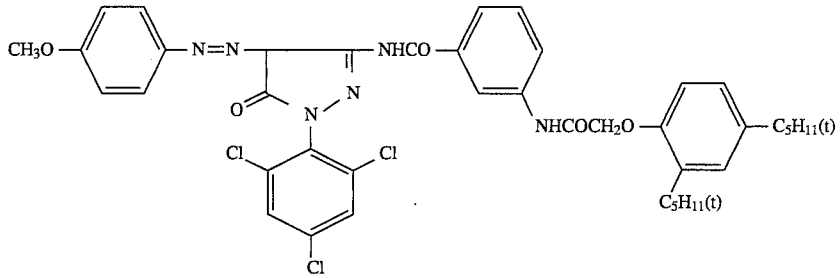
D-1
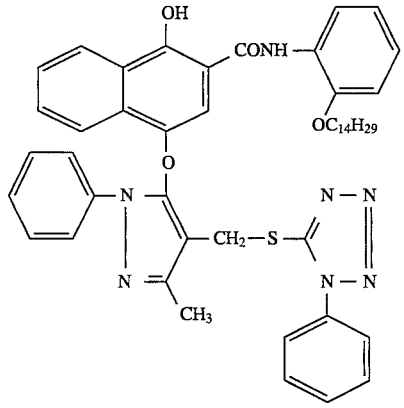
D-2
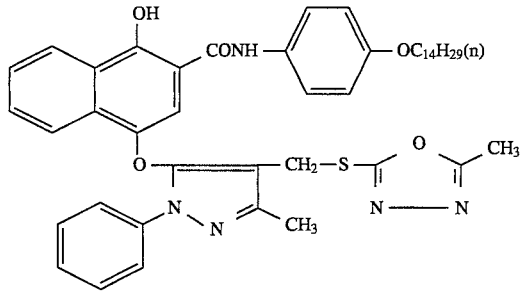

-continued
D-3
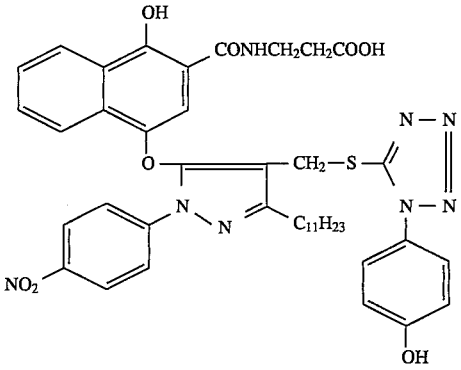
UV-1
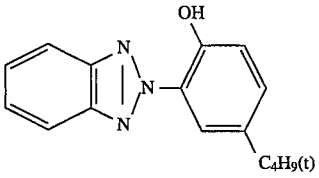
UV-2
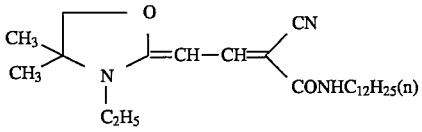
S-1
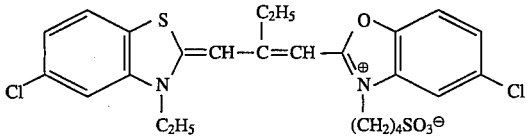
S-2
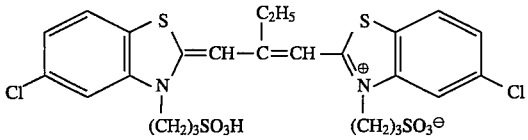
S-3
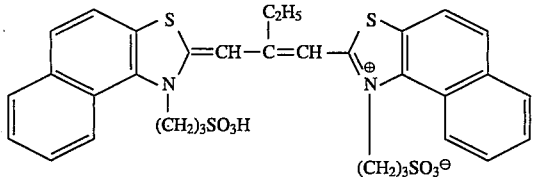
S-4
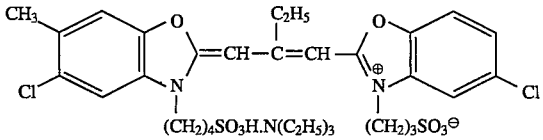
S-5
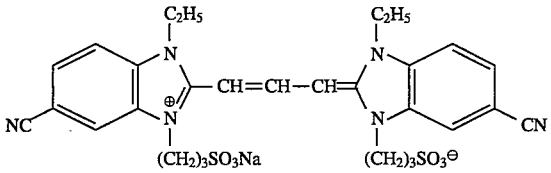
S-6
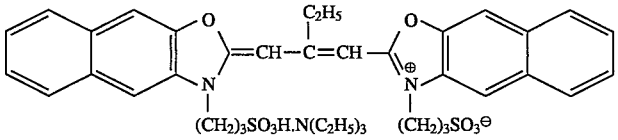

-continued
S-7
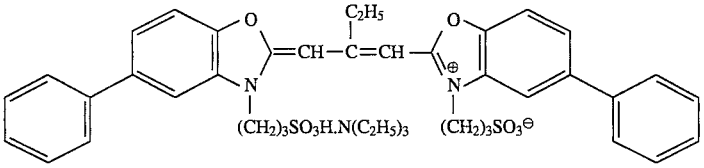
S-8
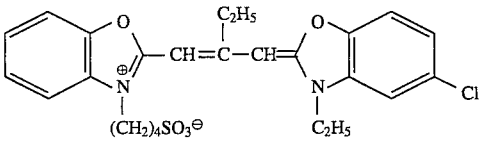
S-9
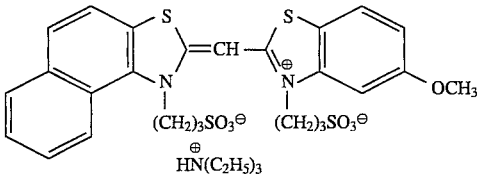
S-10
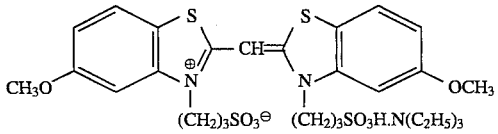
S-11
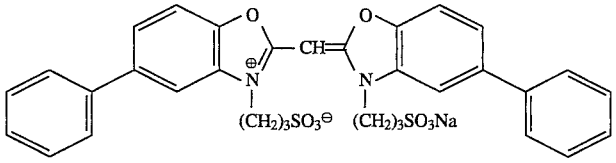
HS-1
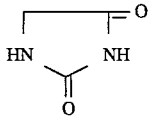
HS-2
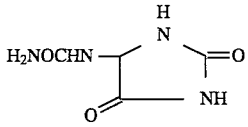
SC-1
a mixture of
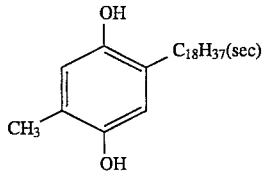
and
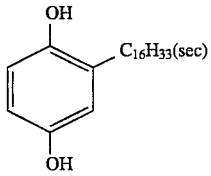
(2:3)
Oil-1
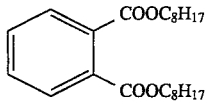
Oil-2
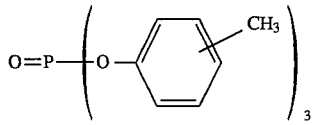
Oil-3
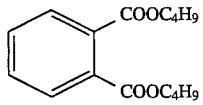

-continued
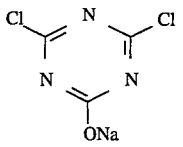
H-1
$(CH_2{=}CHSO_2CH_2)_2O$
H-2
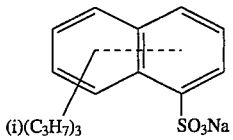
SU-1
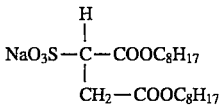
SU-2
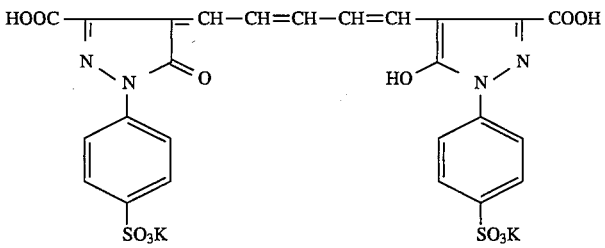
AI-1
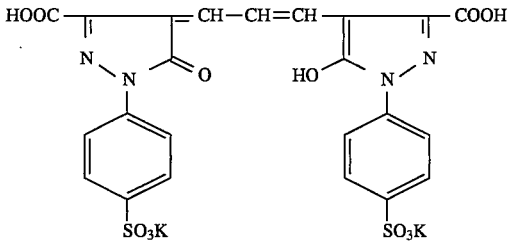
AI-2
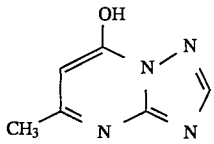
ST-1
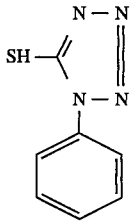
AF-1
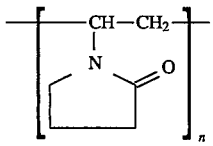
AF-2
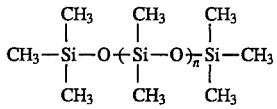
Compound A
(Weight average molecular weight = 30,000)

-continued

Compound B $$NaO_3S-\underset{\underset{CH_2-COOCH_2(CF_2CF_2)_3H}{|}}{CH}-COOCH_2(CF_2CF_2)_3H$$

(Mixture of the following three components)

DI-1

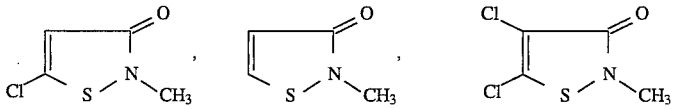

(Component A) (Component B) (Component C)

Component A:Component B:Component C = 50:46:4 (mol ratio)

Compound-I $$HO(CH_2CH_2)_m(\overset{\overset{CH_3}{|}}{C}HCH_2O)_{17}(CH_2CH_2O)_nH$$

(Average molecular weight ≈ 1300)

Samples 202 to 213 were prepared in the same manner as in Sample 201 except that the magenta couplers in 6th layer and 7th layer of Sample 201 were replaced with the equivalent mol of magenta coupler as shown in Table 7. In the above-mentioned manner, light-sensitive materials 201 through 213 prepared in the above-mentioned manner were subjected to exposure to white light through a step wedge for sensitometry. Then in accordance with processing steps as shown in Table 6, the light-sensitive materials 201 through 213 were subjected to photographic processing.

TABLE 6

| Processing step | Processing time | Processing temperature | Replenishment amount |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

*Replenishment amount was a value per 1 $m^2$ of light-sensitive material.

For the color developer, the bleacher, the fixer and their replenishers, the following solutions were used.

| Color developer | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl) aniline sulfate | 4.5 g |
| Diethylene triamine pentaacetic acid | 3.0 g |
| Potassium hydroxide | 1.2 g |

Water was added to make 1 liter in total, and pH was regulated to 10.06 using potassium hydroxide or a 20% sulfuric acid.

| Replenisher for color developer | |
|---|---|
| Water | 800 ml |
| Potassium carbonate | 35 g |
| Sodium hydrogen carbonate | 3 g |
| Potassium sulfite | 5 g |
| Sodium bromide | 0.4 g |

-continued

| | |
|---|---|
| Hydroxylamine sulfate | 3.1 g |
| 4-amino-3-methyl-N-ethyl-N-(β-hydroxyethyl) aniline sulfate | 6.3 g |
| Potassium hydroxide | 2 g |
| Diethylene triamine pentaacetic acid | 3.0 g |

Water was added to make 1 liter in total, and pH was regulated to 10.18 using potassium hydroxide or a 20% sulfuric acid.

| Bleacher | |
|---|---|
| Water | 700 ml |
| Ammonium 1,3-diaminopropane tetraacetic ferric (III) | 125 g |
| Ethylene diamine tetraacetic acid | 2 g |
| Sodium nitrate | 40 g |
| Ammonium bromide | 150 g |
| Glacial acetic acid | 40 g |

Water was added to make 1 liter, and pH was regulated to 4.4 using an aqueous ammonia solution or glacial acetic acid.

| | |
|---|---|
| Water | 700 ml |
| Ammonium 1,3-diaminopropane tetraacetic ferric (III) | 175 g |
| Ethylene diamine tetraacetic acid | 2 g |
| Sodium nitrate | 50 g |
| Ammonium bromide | 200 g |
| Glacial acetic acid | 56 g |

Water was added to make 1 liter after pH was regulated to 4.0 using an aqueous ammonia solution or glacial acetic acid.

| Fixer | |
|---|---|
| Water | 800 ml |
| Ammonium thiocyanate | 120 g |
| Ammonium thiosulfate | 150 g |
| Sodium sulfite | 15 g |
| Ethylene diamine tetraacetic acid | 2 g |

After pH was regulated to 6.2 using ammonia aqueous solution or glacial acetic acid were used, water was added to make 1 liter in total.

| Replenisher for fixer | |
|---|---|
| Water | 800 ml |
| Ammonium thiocyanate | 150 g |
| Ammonium thiosulfate | 180 g |
| Sodium sulfite | 20 g |
| Ethylene diamine tetraacetic acid | 2 g |

After pH was regulated to 6.5 using an aqueous ammonia solution or glacial acetic acid were used, water was added to make 1 liter in total.

| Stabilizer and replenisher for stabilizer | |
|---|---|
| Water | 900 ml |
| The following compound No. 31 | 2.0 g |
| Compound 31 | |

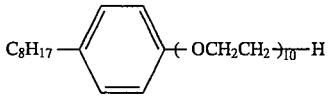

| | |
|---|---|
| Dimethylol urea | 0.5 g |
| Hexamethylene tetramine | 0.2 g |
| 1,2-benzisothiazoline-3-on | 0.1 g |
| Siloxane (L-77 produced by UCC) | 0.1 g |
| Ammonia (aqueous solution) | 0.5 ml |

Water was added to make 1 liter in total, and pH was regulated to 8.5 using ammonia (aqueous solution) or a 50% sulfuric acid.

The maximum magenta color density of each sample subjected to photographic processing was measured by the use of a green light using an optical densitometer PDA-65 (produced by KONICA CORPORATION). Table 2 shows the maximum color density and relative sensitivity. In addition, Samples 201 through 213 were left for 5 days at 55° C., and then subjected to exposure to light and development so that the magenta density was measured. Table 7 shows the relative sensitivity.

TABLE 7

| Sample | Magenta coupler | Maximum density | Relative sensitivity (1) | Relative sensitivity (2) left for 5 days at 55° C. |
|---|---|---|---|---|
| 201 (Comp) | M-1 | 2.40 | 100 | 100 |
| 202 (Inv) | (1) | 2.61 | 113 | 121 |
| 203 (Inv) | (2) | 2.73 | 124 | 144 |
| 204 (Inv) | (9) | 2.59 | 114 | 140 |
| 205 (Inv) | (12) | 2.68 | 121 | 141 |
| 206 (Inv) | (14) | 2.53 | 112 | 138 |
| 207 (Inv) | (22) | 2.72 | 124 | 145 |
| 208 (Inv) | (24) | 2.51 | 112 | 130 |
| 209 (Inv) | (28) | 2.54 | 117 | 149 |
| 210 (Inv) | (29) | 2.63 | 122 | 142 |
| 211 (Inv) | (30) | 2.73 | 126 | 142 |
| 212 (Inv) | (32) | 2.50 | 115 | 122 |
| 213 (Inv) | (33) | 2.56 | 117 | 132 |

The relative sensitivity (1) in Table 7 is a relative value of the inverse of an exposure amount giving the fog density+0.10 density value. Its value is represented by a relative value for the value of Sample 201 which is defined to be 100. In the same manner, relative sensitivity (2) is a relative value for the Sample 101 which is left for 5 days at 55° C. is defined to be 100.

As is apparent from Table 7, it can be understood that Samples 202 through 213 each using the magenta coupler of the present invention are noticeably excellent compared to comparative sample 201 in terms of the maximum density, sensitivity and storage stability.

What is claimed is:

1. A silver halide color photographic light-sensitive material comprises a support having provided thereon at least one green-sensitive silver halide emulsion layer containing at least one of magenta coupler represented by Formula I or II:

Formula I

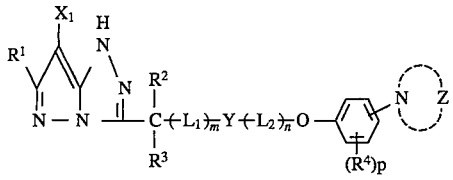

Formula II

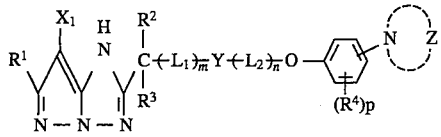

wherein $R^1$ and $R^4$ each represent a substituent; $R^2$ and $R^3$ each represent a substituted or unsubstituted alkyl group; $L_1$ and $L_2$ each represent a substituted or unsubstituted alkylene group, an arylene group, an aralkylene group or an arylenealkylene group; Y represents $$-O-\underset{\underset{O}{\|}}{C}-,\ -\underset{\underset{O}{\|}}{C}-O-,\ -\underset{\underset{O}{\|}}{C}-\underset{\underset{R^5}{|}}{N}-\ \text{or}\ -\underset{\underset{R^6}{|}}{N}-S(O)q-,$$

$R^5$ and $R^6$ each represent a substituent; $X_1$ represents a hydrogen atom or a group capable of splitting off upon reacting with an oxidized product of a color developing agent; Z represents non-metal atomic group forming a 5-membered or 6 -membered heterocyclic ring together with a nitrogen atom; m and n each represent an integer of 0 or 1; p represents an integer of 0 to 4; q represents an integer of 0 to 2, provided that when p is 2 or more, $R^4$ may be the same or different; and each of them may form a ring.

2. The material of claim 1, wherein said material comprises an image-stabilizer represented by Formula A or B:

Formula A

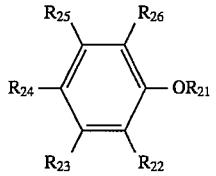

wherein $R_{21}$ represents a hydrogen atom, an alkyl group, an alkenyl group, an aryl group or a heterocyclic group; $R_{22}$, $R_{23}$, $R_{25}$ and $R_{26}$ each represent a hydrogen atom, a halogen atom, a hydroxyl group, an alkyl group, an alkenyl group, an aryl group, an alkoxy group or an acylamino group; $R_{24}$ represents an alkyl group, a hydroxyl group, an aryl group, an alkoxy group, an alkenyloxy group or an aryloxy group;

Formula B

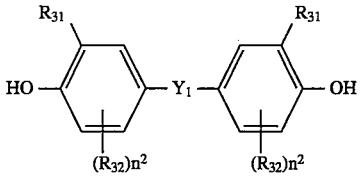

wherein $R_{31}$ represents a secondary or tertiary alkyl group, a secondary or tertiary alkenyl group, a cycloalkyl group or an aryl group; $R_{32}$ represents a halogen atom, an alkyl group, an alkenyl group, a cycloalkyl group or an aryl group; and $n^2$ is an integer of 0 to 3; provided that, when two or more each of $R_{31}$ and $R_{32}$ are present, they may be the same with or the different from each other. $Y_1$ represents S, SO, $SO_2$ or an alkylene group.

3. The material of claim 1, wherein said magenta coupler is Formula I:

Formula I

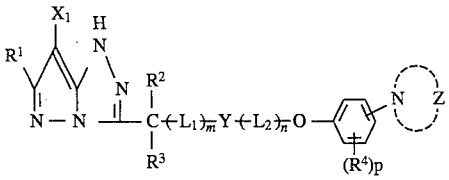

wherein $R^1$ and $R^4$ each represent a substituent; $R^2$ and $R^3$ each represent a substituted or unsubstituted alkyl group; $L_1$ and $L_2$ each represent a substituted or unsubstituted alkylene group, an arylene group, an aralkylene group or an arylenealkylene group; Y represents

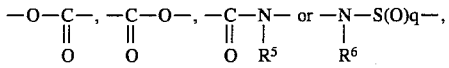

$R^5$ and $R^6$ each represent a substituent; $X_1$ represents a hydrogen atom or a group capable of splitting off upon reacting with an oxidized product of a color developing agent; Z represents non-metal atomic group forming a 5-membered or 6-membered heterocyclic ring together with a nitrogen atom; m and n each represent an integer of 0 or 1; p represents an integer of 0 to 4; q represents an integer of 0 to 2, provided that when p is 2 or more, $R^4$ may be the same or different; and each of them may form a ring.

4. The material of claim 3, wherein said material comprises an image-stabilizer represented by Formula A or B:

Formula A

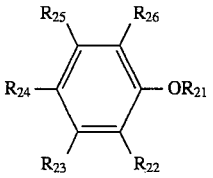

wherein $R_{21}$ represents a hydrogen atom, an alkyl group, an alkenyl group, an aryl group or a heterocyclic group; $R_{22}$, $R_{23}$, $R_{25}$ and $R_{26}$ each represent a hydrogen atom, a halogen atom, a hydroxyl group, an alkyl group, an alkenyl group, an aryl group, an alkoxy group or an acylamino group; $R_{24}$ represents an alkyl group, a hydroxyl group, an aryl group, an alkoxy group, an alkenyloxy group or an aryloxy group;

Formula B

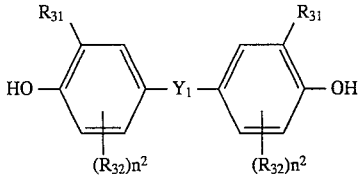

wherein $R_{31}$ represents a secondary or tertiary alkyl group, a secondary or tertiary alkenyl group, a cycloalkyl group or an aryl group; $R_{32}$ represents a halogen atom, an alkyl group, an alkenyl group, a cycloalkyl group or an aryl group; and $n^2$ is an integer of 0 to 3; provided that, when two or more each of $R_{31}$ and $R_{32}$ are present, they may be the same with or the different from each other. $Y_1$ represents S, SO, $SO_2$ or an alkylene group.

5. The material of claim 1, wherein said magenta coupler is Formula II:

Formula II

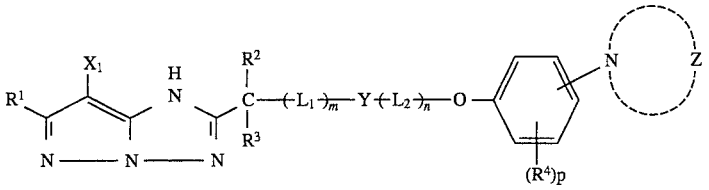

wherein $R^1$ and $R^4$ each represent a substituent; $R^2$ and $R^3$ each represent a substituted or unsubstituted alkyl group; $L_1$ and $L_2$ each represent a substituted or unsubstituted alkylene group, an arylene group, an aralkylene group or an arylenealkylene group; Y represents

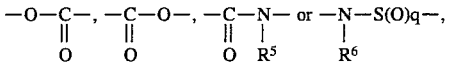

$R^5$ and $R^6$ each represent a substituent; $X_1$ represents a hydrogen atom or a group capable of splitting off upon reacting with an oxidized product of a color developing agent; Z represents non-metal atomic group forming a 5-membered or 6-membered heterocyclic ring together with a nitrogen atom; m and n each represent an integer of 0 or 1; p represents an integer of 0 to 4; q represents an integer of 0 to 2, provided that when p is 2 or more, $R^4$ may be the same or different; and each of them may form a ring.

6. The material of claim 5, wherein said material comprises an image-stabilizer represented by Formula A or B:

Formula A

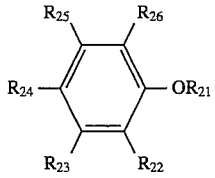

wherein $R_{21}$ represents a hydrogen atom, an alkyl group, an alkenyl group, an aryl group or a heterocyclic group; $R_{22}$, $R_{23}$, $R_{25}$ and $R_{26}$ each represent a hydrogen atom, a halogen atom, a hydroxyl group, an alkyl group, an alkenyl group, an aryl group, an alkoxy group or an acylamino group; $R_{24}$ represents an alkyl group, a hydroxyl group, an aryl group, an alkoxy group, an alkenyloxy group or an aryloxy group;

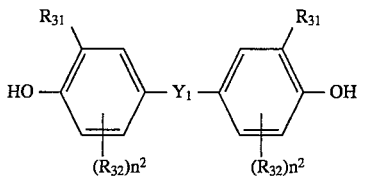

Formula B wherein $R_{31}$ represents a secondary or tertiary alkyl group, a secondary or tertiary alkenyl group, a cycloalkyl group or an aryl group; $R_{32}$ represents a halogen atom, an alkyl group, an alkenyl group, a cycloalkyl group or an aryl group; and $n^2$ is an integer of 0 to 3; provided that, when two or more each of $R_{31}$ and $R_{32}$ are present, they may be the same with or the different from each other. $Y_1$ represents S, SO, $SO_2$ or an alkylene group.

7. The material of claim 1, wherein said $R^1$ of said Formula I or said Formula II is an alkyl group having 1 to 32 carbon atoms or an aryloxy group, and said

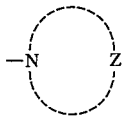

group is selected from the group consisting of

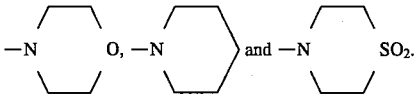

8. The material of claim 1, wherein said $R^1$ of said Formula I or said Formula II is an alkyl group having 1 to 5 carbon atoms or an aryloxy group, and said

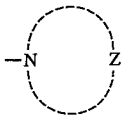

group is selected from the group consisting of

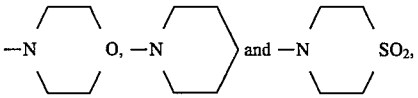

and said $X_1$ is a halogen atom.

* * * * *